US008421830B2

(12) United States Patent
Shinohara

(10) Patent No.: US 8,421,830 B2
(45) Date of Patent: Apr. 16, 2013

(54) METHOD OF FORMING IMAGE USING HEAT-SENSITIVE TRANSFER IMAGE-RECEIVING SHEET HAVING A LENTICULAR LENS

(75) Inventor: Ryuji Shinohara, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 65 days.

(21) Appl. No.: 13/239,263

(22) Filed: Sep. 21, 2011

(65) Prior Publication Data

US 2012/0075400 A1 Mar. 29, 2012

(30) Foreign Application Priority Data

Sep. 29, 2010 (JP) ..... 2010-219518

(51) Int. Cl.
*B41J 2/335* (2006.01)

(52) U.S. Cl.
USPC ..... 347/197

(58) Field of Classification Search ..... 347/190, 347/191, 193, 197, 198, 220, 221; 400/120.01, 400/120.16, 120.17
See application file for complete search history.

(56) References Cited

U.S. PATENT DOCUMENTS

| | | | | |
|---|---|---|---|---|
| 6,211,894 | B1 * | 4/2001 | Yamaya et al. | 347/193 |
| 6,923,532 | B2 * | 8/2005 | Foster et al. | 347/193 |
| 2006/0227204 | A1 * | 10/2006 | Chamandy | 347/193 |

FOREIGN PATENT DOCUMENTS

| | | | |
|---|---|---|---|
| JP | 5-131760 | A | 5/1993 |
| JP | 6-282019 | A | 10/1994 |
| JP | 9-300828 | A | 11/1997 |
| JP | 3609065 | B2 | 1/2005 |
| JP | 3789033 | B2 | 6/2006 |
| JP | 2008-155612 | A | 7/2008 |

* cited by examiner

*Primary Examiner* — Kristal Feggins
(74) *Attorney, Agent, or Firm* — Sughrue Mion, PLLC

(57) ABSTRACT

A method of forming an image, having the steps of: superposing a heat-sensitive transfer sheet on a heat-sensitive transfer image-receiving sheet; and applying thermal energy, in which the heat-sensitive transfer sheet has a dye transfer barrier layer between a support and a dye layer, the image-receiving sheet has a lenticular lens on a transparent support and at least one receptor layer at the back side of the transparent support, and the image-receiving sheet contains at least one kind of a latex polymer in said at least one receptor layer and has a subbing layer which contains at least one kind of a resin that is identical with at least one kind of a resin constituting the lenticular lens, at the side of the transparent support, opposite to the side on which the lenticular lens is provided.

9 Claims, 1 Drawing Sheet

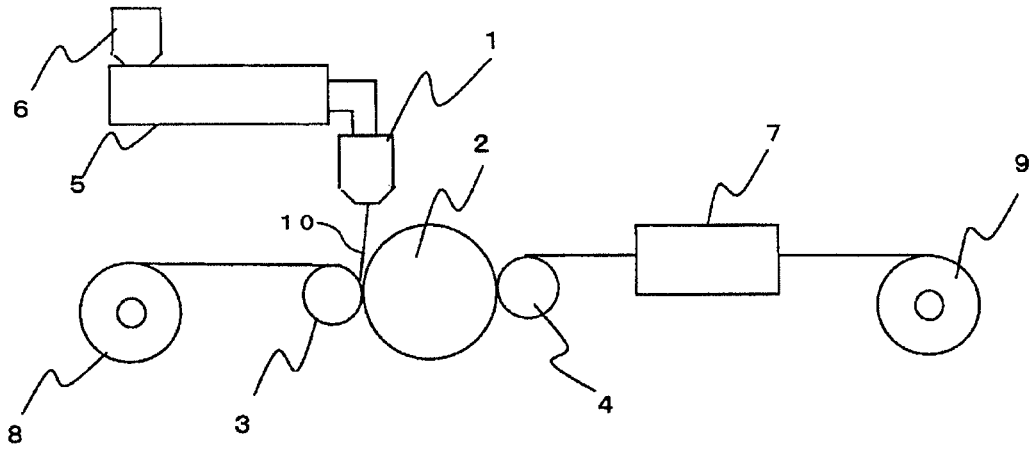
1
2
3
4
5
6
7
8
9
10

METHOD OF FORMING IMAGE USING HEAT-SENSITIVE TRANSFER IMAGE-RECEIVING SHEET HAVING A LENTICULAR LENS

FIELD OF THE INVENTION

The present invention relates to a method of forming image using a heat-sensitive transfer image-receiving sheet having a lenticular lens, which is used for dye diffusion transfer recording, and relates to a system using thereof.

BACKGROUND OF THE INVENTION

In a dye diffusion transfer recording system (hereinafter also referred to as a sublimation transfer recording system), a heat-sensitive transfer sheet (hereinafter simply also referred to as an ink sheet) containing a colorant (hereinafter also referred to as a dye) is superposed on a heat-sensitive transfer image-receiving sheet (hereinafter simply also referred to as an image-receiving sheet), and then the heat-sensitive transfer sheet is heated by a thermal head whose exothermic action is controlled by electric signals, in order to transfer the dyes contained in the heat-sensitive transfer sheet to the image-receiving sheet, thereby recording an image information. Three colors: cyan, magenta, and yellow, or four colors which consist of the three colors and black are used for recording a color image by overlapping one color to other, thereby enabling transferring and recording a color image having continuous gradation for color densities.

On the other hand, in recent years, the demands on color images are diversified, and there is a demand for obtaining three-dimensional images conveniently and inexpensively. It has been known that, so as to make a picture, a photograph, or the like being stereoscopically viewed, a lenticular lens (sheet-shaped) formed from semi-cylindrical lenses is attached on a printed picture or photograph correspondingly to the right-side eye and the left-side eye. In order to make the picture, photograph, or the like being stereoscopically viewed with high precision in this technique, it is required that the printed images viewed respectively by the right-side eye and the left-side eye are disposed in correspondence with the positions of the respective lenses of the lenticular lens.

Japanese Patent No. 3609065 discloses an image recording apparatus equipped with a recording unit that records an image on the back side of the lenticular lens sheet, a moving mechanism for moving the recording unit and the lenticular lens sheet relatively to each other, a position detecting unit provided to be contacted with the concave parts and/or convex parts of the lenticular lens sheet, and a recording control unit that controls the recording unit to perform recording while detecting the position of the lenticular lens sheet by means of the position detecting unit.

Japanese Patent No. 3789033 and JP-A-9-300828 ("JP-A" means unexamined published Japanese patent application) discloses a method of producing a lenticular lens sheet printed material, including: preparing a heat transfer sheet provided with a coloring material transfer unit and a white layer transfer unit in area order on the same surface of a substrate film; thermally moving the coloring material from the coloring material transfer unit to the back surface of the lenticular lens sheet by using a heating device; and subsequently thermally transferring the white layer.

JP-A-6-282019 discloses a heat-sensitive transfer recording sheet for stereoscopic photographs, which utilizes the lenticular lens sheet as a substrate and has a dye receptor layer provided on the back side of the lenticular lens sheet.

JP-A-5-131760 and JP-A-2008-155612 disclose a heat-sensitive transfer sheet, in which a hydrophilic dye barrier layer, containing a polyvinylpyrrolidone and a polyvinyl alcohol, is used, as a dye transfer barrier layer, in order to enhance dye transfer efficiency, and a heat-sensitive transfer sheet having, as a dye transfer barrier layer, a subbing layer, containing a copolymer resin of a polyvinylpyrrolidone and a vinyl acetate and colloidal inorganic pigment fine particles as main components, in order to enhance dye transfer efficiency.

In the heat-sensitive transfer image-receiving sheet having a lenticular lens as described above, since stereoscopic images are viewed from the side of the lenticular lens, it is impossible to use an opaque heat-insulating layer (e.g. a heat-insulating layer composed of stretched polyolefin film, or a heat-insulating layer containing a hollow polymer) between a receptor layer and a support. Accordingly, in the case where images are output in a combination of the heat-sensitive transfer image-receiving sheet having a lenticular lens sheet as described above and a heat-sensitive transfer sheet which does not have the heat-insulating layer as described above in order to obtain high density images, this case causes a problem that a ribbon at a black or high-density image section gets wrinkled, since the ribbon is adversely affected by the heat of a thermal head, and resultantly an image defect of the same shape (wrinkle shape) is likely to generate. Further, since images are viewed through the lenticular lens, a new problem has been caused that an image defect (shift of register in color printing) in which yellow, magenta, and cyan images shift becomes easily-noticeable, and resultantly image defects such as shift of register in color printing are likely to generate.

SUMMARY OF THE INVENTION

The present resides in a method of forming an image, having the steps of:

superposing a heat-sensitive transfer sheet on a heat-sensitive transfer image-receiving sheet; and applying thermal energy in accordance with image signals from a thermal head, wherein the heat-sensitive transfer sheet has a dye transfer barrier layer containing at least one kind of a water-soluble polymer or at least one kind of inorganic fine particles between a support and a dye layer, wherein the heat-sensitive transfer image-receiving sheet has a lenticular lens on a transparent support and at least one receptor layer at the back side of the transparent support, and wherein the heat-sensitive transfer image-receiving sheet contains at least one kind of a latex polymer in said at least one receptor layer and has a subbing layer which contains at least one kind of a resin that is identical with at least one kind of a resin constituting the lenticular lens, at the side of the transparent support, opposite to the side on which the lenticular lens is provided.

Other and further features and advantages of the invention will appear more fully from the following description, appropriately referring to the accompanying drawing.

BRIEF DESCRIPTION OF THE DRAWING

FIG. 1 is an example of an overall process chart of an extrusion lamination equipment.

DETAILED DESCRIPTION OF THE INVENTION

According to the present invention, there are provided the following means:

(1) A method of forming an image, having the steps of:

superposing a heat-sensitive transfer sheet on a heat-sensitive transfer image-receiving sheet; and applying thermal energy in accordance with image signals from a thermal head, wherein the heat-sensitive transfer sheet has a dye transfer barrier layer containing at least one kind of a water-soluble polymer or at least one kind of inorganic fine particles between a support and a dye layer, wherein the heat-sensitive transfer image-receiving sheet has a lenticular lens on a transparent support and at least one receptor layer at the back side of the transparent support, and wherein the heat-sensitive transfer image-receiving sheet contains at least one kind of a latex polymer in said at least one receptor layer and has a subbing layer which contains at least one kind of a resin that is identical with at least one kind of a resin constituting the lenticular lens, at the side of the transparent support, opposite to the side on which the lenticular lens is provided.

(2) The method of forming an image as described in the above item (1), wherein said at least one kind of a resin that constitutes the subbing layer and is identical with said at least one kind of a resin that constitutes the lenticular lens is a polymethyl methacrylate resin, a polycarbonate resin, a polystyrene resin, a methacrylate-styrene copolymer resin, a polyethylene resin, a polyethylene terephthalate resin, or a glycol-modified polyethylene terephthalate resin.

(3) The method of forming an image as described in the above item (1) or (2), wherein said at least one of a resin that constitutes the subbing layer and is identical with said at least one kind of a resin that constitutes the lenticular lens is a glycol-modified polyethylene terephthalate resin.

(4) The method of forming an image as described in any one of the above items (1) to (3), wherein at least one kind of the latex polymer is a copolymer containing a vinyl chloride component as a constituent component.

(5) The method of forming an image as described in any one of the above items (1) to (4), wherein at least one of the latex polymer is a vinyl chloride homopolymer or a vinyl chloride/acrylic acid ester copolymer.

(6) The method of forming an image as described in any one of the above items (1) to (5), wherein the transparent support is a polyethylene terephthalate resin.

(7) The method of forming an image as described in any one of the above items (1) to (6), wherein the water-soluble polymer contained in the dye transfer barrier layer is one selected from the group consisting of a water-soluble polymer having a repeating unit obtained from N-vinylpyrrolidone, a gelatin, and a polyvinyl alcohol.

(8) The method of forming an image as described in any one of the above items (1) to (7), wherein the inorganic fine particles contained in the dye transfer barrier layer are one selected from the group consisting of colloidal silica, alumina sols, and titanium oxide sols.

(9) A system of forming an image, having the steps of:

superposing a heat-sensitive transfer sheet on a heat-sensitive transfer image-receiving sheet; and applying thermal energy in accordance with image signals from a thermal head, wherein the heat-sensitive transfer sheet has a dye transfer barrier layer containing at least one kind of a water-soluble polymer or at least one kind of inorganic particles between a support and a dye layer, wherein the heat-sensitive transfer image-receiving sheet has a lenticular lens on a transparent support and at least one receptor layer at the back side of the transparent support, and wherein the heat-sensitive transfer image-receiving sheet contains at least one kind of a latex polymer and has a subbing layer which contains at least one kind of a resin that is identical with at least one kind of a resin constituting the lenticular lens, at the side of the transparent support, opposite to the side on which the lenticular lens is provided.

Hereinafter, the present invention is described in detail. In the present specification, "to" denotes a range including numerical values described before and after it as a minimum value and a maximum value.

The heat-sensitive transfer image-receiving sheet in the present invention is explained in detail below.

<Heat-sensitive Transfer Image-receiving Sheet>

The heat-sensitive transfer image-receiving sheet in the present invention has a lenticular lens and at least one receptor layer on a transparent support, and has a subbing layer composed of a resin that is identical with a resin constituting the lenticular lens, on the side of the transparent support that is opposite to the side on which the lenticular lens is provided.

[Support]

A support of the heat-sensitive transfer image-receiving sheet in the present invention is a transparent support, and it is preferable that the transparent support has a sheet surface that is as smooth as possible. Further, the support is required to endure the heat of a melt and extruded resin sheet, and a polycarbonate resin, a polysulfone resin, a polyimide resin, a biaxially stretched polyethylene terephthalate resin and the like, which have relatively a high heat resistance, may be used for the support. Particularly, from the view point of well smoothness, a biaxially stretched polyethylene terephthalate resin is preferable.

Further, in order to make a resin for forming the subbing layer and the lenticular lens more rigidly adhere to the transparent support, it is particularly preferable that an adhesive resin is provided, namely, an adhesive resin layer is provided, on the transparent support. Examples of this adhesive resin include a modified polyolefin-series resin, a polyester-series thermoplastic elastomer, and the like. Among these adhesive resins, a modified polyolefin-series resin is preferable, and an acid-modified polyolefin resin is more preferable. The acid-modified polyolefin resin is not particularly limited, as long as it is a polyolefin resin modified, with an unsaturated carboxylic acid or its derivative. Examples of the unsaturated carboxylic acid include maleic acid, itaconic acid, and fumaric acid. Examples of their derivatives include esters and anhydrides such as maleic acid monoester, maleic acid diester, maleic anhydride, itaconic acid monoester, itaconic acid diester, itaconic anhydride, fumaric acid monoester, fumaric acid diester, and fumaric anhydride. Examples of the above-described polyolefin resin include ethylene-series copolymers such as a straight-chain polyethylene, an ultralow density polyethylene, a high density polyethylene, an ethylene-vinyl acetate (VA) copolymer, an ethylene-ethyl acrylate (EA) copolymer, and an ethylene-methacrylate copolymer, a propylene-series polymer, and a styrene-series elastomer. The acid-modified polyolefin resin may be used singly or in combination of two or more kinds thereof. Further, a polyolefin resin which is not modified by an acid may be blended therewith in such an amount that coexistence of the same is not contrary to the aims of the present invention.

Specific examples of the acid-modified polyolefin resin include ADMER (trade name, manufactured by Mitsui Chemicals, Inc.), ADTEX (trade name, manufactured by Japan Polyethylene Corporation), POLYBOND (trade name, manufactured by Crompton Corporation) and BONDFAST (trade name, manufactured by Sumitomo Chemical Co., Ltd.).

As for the adhesive resin, the adhesive resin layer may be formed by providing an adhesive resin on one surface or both surfaces of a transparent thermoplastic resin for forming the transparent support, and subjecting them to co-extrusion. This embodiment is especially preferable in the present invention.

The average thickness of the adhesive resin layer between the transparent support and the lenticular lens resin layer is preferably 5 to 40 μm, more preferably 5 to 30 μm, and particularly preferably 6 to 30 μm.

The average thickness of the adhesive resin layer between the transparent support and the subbing layer is preferably 5 to 20 μm, more preferably 5 to 15 μm, and particularly preferably 6 to 10 μm.

[Subbing Layer]

The subbing layer is provided on the side of the transparent support that is opposite to the side of the transparent support on which the lenticular lens is provided.

In the present invention, at least one kind of a resin that constitutes the subbing layer is identical with at least one kind of a resin that constitutes the lenticular lens. If the resin constituting the subbing layer and the resin constituting the lenticular lens, respectively, include multiple resins, it is preferable that all of the multiple resins are identical with each other.

Examples of the resin that constitutes the subbing layer include a polymethyl methacrylate resin (PMMA), a polycarbonate resin, a polystyrene resin, a methacrylate-styrene copolymer resin (MS resin), an acrylonitrile-styrene copolymer resin (AS resin), a polypropylene resin, a polyethylene resin, a polyethylene terephthalate resin, a glycol-modified polyethylene terephthalate resin, a polyvinyl chloride resin (PVC), a thermoplastic elastomer, or copolymers thereof, a cycloolefin polymer, and the like. Upon considering the ease of melt and extrusion, it is preferable to use a resin having a low melt viscosity, for example, a polymethyl methacrylate resin (PMMA), a polycarbonate resin, a polystyrene resin, a methacrylate-styrene copolymer resin (MS resin), a polyethylene resin, a polyethylene terephthalate resin, or a glycol-modified polyethylene terephthalate resin. On the other hand, upon considering the ease of transfer, difficulty of cracking in the sheet, durability of a pattern and the like, it is more preferable to use a glycol-modified polyethylene terephthalate resin.

(Formation of Subbing Layer)

Formation of the subbing layer on the transparent support is carried out by steps, in which an embossed roller 2 is changed to a mirror-surface roller by using an apparatus shown in FIG. 1. A method is preferably used, in which the subbing layer is continuously formed by inserting a moving transparent support 8 between the mirror-surface roller 2 and a nip roller 3, extruding a transparent thermoplastic resin 10 from a sheet die 1, thereby to be supplied between the transparent support 8 and the mirror-surface roller 2 and to be laminated on the moving transparent support 8, and solidifying the resultant sheet by cooling while winding the resultant sheet around the mirror-surface roller 2. Subsequently to the formation of the subbing layer, it is also preferable to provide the receptor layer described below by using a coating and drying step 7.

[Lenticular Lens]

The resin that constitutes the lenticular lens is preferably the same kind as that of the resin that constitutes the subbing layer, and the preferable examples are the same as those of the subbing layer.

(Formation of Lenticular Lens)

As shown in FIG. 1, a pattern of the lenticular lens can be provided by a method, including the steps: providing a lenticular lens forming resin layer on a sheet 8 in which the subbing layer is formed on the transparent support or on a sheet 8 in which the receptor layer described below is coated after forming the subbing layer; and forming a fine pattern on the surface of this lenticular lens forming resin layer. In detail, the pattern of the lenticular lens can be preferably produced by a method of continuously transferring a pattern shape onto the surface of the moving sheet, in which the sheet 8 prior to laminating a resin layer for forming a lenticular lens thereon is inserted between the embossed roller 2 having the desired pattern shape and the nip roller 3, while the transparent thermoplastic resin sheet 10 for forming the lenticular lens with the adhesive resin are co-extruded from the sheet die 1, thereby to be inserted with the sheet 8 prior to laminating the resin layer for forming a lenticular lens layer between the embossed roller 2 and the nip roller 3, and the sheet 10 is laminated on the sheet 8 by being pressed by the nip roller 3. At this time, it is preferable that, by solidifying the laminated sheet by cooling while being wound around the embossed roller 2, a pattern shape is continuously transferred to the surface of the moving thermoplastic resin sheet 10. 9 represents a roll of a heat-sensitive transfer image-receiving sheet having the lenticular lens obtained by being laminated and formed as described above. In FIG. 1, 4 represents a peeling roller that peels the heat-sensitive transfer image-receiving sheet having a lenticular lens 9 from the embossed roller 2. In FIG. 1, 5 represents an extruder that extrudes the transparent thermoplastic resin for forming the lenticular lens 10 fed from a resin hopper 6 described below.

The pattern shape of the lenticular lens resin layer in the present invention may be a conventional pattern shape and is not particularly limited. However, a preferable shape is such that the height of the lens is 60 to 80 μm, the lens pitch is 100 to 318 μm, the radius is 100 to 200 μm, and the thickness of the lens sheet is 200 to 400 μm.

Hereinafter, a preferable producing process of the lenticular lens sheet described above is explained in detail.

Herein, the term "lenticular lens sheet" means a sheet on which at least the subbing layer, the receptor layer, and the lenticular lens resin layer are formed. In addition, the lenticular lens sheet may have the adhesive resin layer. In the present invention, the lenticular lens sheet having the adhesive resin layer is a preferable embodiment. The term "patterned sheet" means a sheet, in which a concavo-convex pattern of the lenticular lens is formed.

FIG. 1 is an example of an overall process diagram showing the method of producing a patterned sheet. As shown in FIG. 1, the method of producing the patterned sheet mainly includes: 1) a raw material step of conducting metering and mixing of raw materials; 2) an extrusion step of continuously extruding a molten resin into a sheet form (band form); 3) a transport step of conveying the sheet prior to having the lenticular lens resin layer, which is wound as roll shape; 4) a cooling and transfer step of feeding the extruded resin sheet between the embossed roller and the sheet prior to having the lenticular lens resin layer, and solidifying by cooling the sheets while laminating the sheets by pressing with the rubber roller (nip roller), thereby to transfer the pattern shape; 5) a peeling step of peeling the laminated and solidified resin sheet from the embossed roller; and 6) a rolling step of rolling up the obtained sheet into a roll form. In this manner, the lenticular lens forming resin is laminated, and the concavo-convex pattern of the lens is formed on the laminated resin.

With respect to the sheet prior to having the lenticular lens resin layer, at first, the subbing layer is coated on the transparent support as described above. In this case, the mirror-surface roller is used in exchange of the above-described embossed roller 2 in FIG. 1. The steps 1), 2) and 6) of the method of producing a patterned sheet are common in the process. In the process, the above-described step 3) corresponds to the transport step of conveying the transparent support wound in a roll shape. The above-described step 4) corresponds to the cooling and transfer step of feeding the extruded resin sheet between the transparent support and the mirror-surface roller and solidifying by cooling the extruded resin sheet while laminating the extruded resin sheet by pressing with the rubber roller. The above-described step 5) corresponds to the peeling step of peeling the laminated and solidified resin sheet from the mirror-surface roller. Herein, the steps 3) to 5) in the case of coating the subbing layer on the transparent support are only different from the case of coating the lenticular lens resin layer in terms of using the mirror-surface roller in exchange of the embossed roller. Namely, there is only a difference in presence or absence of the pattern on the resin and a difference in a sheet prior to coating (a transparent support or a sheet prior to having the lenticular lens resin layer) between these cases. Accordingly, a preferable embodiment of the steps 3) to 5) with respect to the embossed roller as described later is applicable.

Then, on the subbing layer of the thus-obtained sheet (the sheet in which the subbing layer is formed on the transparent support), the receptor layer is coated and dried. In this manner, the sheet prior to having the lenticular lens resin layer, which is used for the production of the patterned sheet as described above, is produced.

In the raw material step, a raw material resin sent from a raw material silo (or a raw material tank) to a vacuum dryer is dried until a predetermined moisture content is obtained.

In the extrusion step, the dried raw material resin is fed into an extruder 5 via a hopper 6, and is melted while being kneaded by this extruder 5. The extruder 5 may be a single-screw extruder or a multi-screw extruder, and may also have a vent function for evacuating the inside of the extruder 5. The raw material resin melted by the extruder 5 is sent to the die 1 (for example, a T-die) via a supply duct. At this time, plural extruders may be used to merge at a feed block and form a multilayer. In order to enhance the adhesiveness of the transparent support to the lenticular lens resin layer, the adhesive resin may be disposed between the lenticular lens resin layer and the transparent support. The resin sheet extruded into a sheet shape from the die 1 is then sent to the cooling and transfer step.

Herein, the sheet 8 prior to having the lenticular lens resin layer is conveyed from the transport step and enters the cooling and transfer step between the embossed roller 2 and the nip roller 3. In the cooling and transfer step, the resin sheet 10 extruded from the die is supplied between the sheet 8 prior to having the lenticular lens resin layer and the embossed roller 2, and is solidified by cooling while being laminated by pressing with the nip roller 3, and thereby the pattern shape is transferred. The solidified patterned sheet is peeled by the peeling roller 4.

On the surface of the embossed roller 2, for example, a reversal shape for molding the patterned sheet is formed. As a material of the embossed roller 2, various steel members, stainless steel, copper, zinc, brass; products produced by using these metallic materials as core metals and subjecting the materials to plating such as hard chrome plating (HCr plating), Cu plating, or Ni plating; ceramics, and various composite materials can be employed.

The nip roller 3 is a roller which is disposed at the side of the embossed roller 2 opposite to the side to which the peeling roller 4 is attached and is intended to compress the substrate sheet 8 and the resin sheet together with the embossed roller 2. Regarding the material for the nip roller 3, various steel members, stainless steel, copper, zinc, brass, and products produced by using these metallic materials as core metals and providing a rubber lining on the surface thereof, can be employed.

The nip roller 3 is provided with pressing units that are not depicted in FIG. 1, such that the pressing unit can compress the substrate sheet 8 and the resin sheet 10 between the nip roller 3 and the embossed roller 2 with a predetermined pressure. All the pressing units are constructed to apply pressure in the normal line direction at the contact point of the nip roller 3 and the embossed roller 2, and various known units such as a motor-driven unit, an air cylinder, and a hydraulic cylinder can be employed.

For the nip roller 3, a construction, which is not likely to generate deflection due to the reaction force of the compressing force, can be employed. Examples of such construction that can be employed include a construction of providing a back-up roller which is not depicted in the diagram, on the rear side of the nip roller 3 (the side opposite to the embossed roller), a construction of employing a crown shape (a shape having a peak in the middle), a construction of using a roller having a strength distribution such that the hardness at the central part in the direction of the axis of the roller is large, and constructions combining these.

The peeling roller 4 is a roller which is disposed at the side of the embossed roller 2 opposite to the side to which the nip roller 3 is attached and is intended to peel off the sheet on which the concavo-convex pattern of the lenticular lens has been formed, from the embossed roller 2 by winding the patterned sheet around the peeling roller. As a material of the peeling roller, for example, various steel members, stainless steel, copper, zinc, brass, and products produced by using these metallic materials as metal cores and providing a rubber lining on the surface thereof, can be employed.

The temperature of the embossed roller 2 is preferably set such that the temperature of the resin sheet at the compressed part is at or above the glass transition temperature, so that the resin sheet is not cooled and solidified before the transfer to the compressed resin sheet is completed. On the other hand, in the case where the adhesion between the embossed roller and the sheet on which the concavo-convex pattern of the lenticular lens has been formed is too strong in the peeling step using the peeling roller, the patterned sheet peels off irregularly and is deformed into a protruded shape. Therefore, it is preferable to set the temperature of the embossed roller at the lowest possible temperature to achieve transfer. In the case of employing a glycol-modified polyethylene terephthalate resin as the resin material, the surface temperature of the embossed roller can be set at 30 to 90° C., and preferably 40 to 70° C. In order to control the temperature of the embossed roller, a known method, such as filling the inside of the embossed roller with a thermal medium (warm water, oil) and circulating the thermal medium, can be employed.

The ejection temperature of the molten resin from the die 1 is preferably set such that the temperature of the resin sheet at the compressed part is at or above the glass transition temperature, so that the resin sheet is not cooled and solidified before the transfer to the compressed resin sheet is completed.

On the other hand, in the case where the adhesion between the embossed roller 2 and the sheet on which the concavo-convex pattern of the lenticular lens has been formed is too strong in the peeling step using the peeling roller 4, the patterned sheet peels off irregularly and is deformed into a protruded shape. Furthermore, since there occur problems such as deterioration of the surface state due to thermal decomposition of the resin, it is preferable to set the ejection temperature at the lowest possible temperature to achieve transfer. In the case of employing the glycol-modified polyethylene terephthalate resin as the resin material, the ejection temperature from the die can be set at 240 to 290° C., and preferably at 250 to 280° C.

[Receptor Layer]

The heat-sensitive transfer image-receiving sheet used in the present invention has at least one receptor layer on the subbing layer.

The receptor layer contains a resin which plays a role of being dyed with a dye migrated from the heat-sensitive transfer sheet and maintaining a formed image. In the present invention, the receptor layer at least contains a latex polymer. It is preferable in the present invention that the heat-sensitive transfer image-receiving sheet has two or more receptor layers (preferably two receptor layers). It is a preferable embodiment that an undercoat layer is provided between the subbing layer and the receptor layer so as to impart various functions such as white background adjustment, charge prevention, adhesiveness, cushion properties, and smoothness.

(Latex Polymer)

In the present specification, the term "latex polymer" means a dispersion in which water-insoluble hydrophobic polymers are dispersed as fine particles in a water-soluble dispersion medium. The dispersed state may be one in which spherical polymer-polymerized particles and/or a polymer are emulsified in the dispersion medium, one in which the spherical polymer-polymerized particles and/or a polymer have undergone emulsion polymerization, one in which the spherical polymer-polymerized particles and/or a polymer have undergone micelle dispersion, one in which the polymer molecules partially have a hydrophilic structure and the molecular chains themselves are dispersed in a molecular state, or the like. Among them, the spherical polymer-polymerized particles are particularly preferable.

In addition to the latex polymer as a receptor polymer which receives the dye migrated from the heat-sensitive transfer sheet and thereby forms a recorded image at the time of heat-sensitive transfer, the receptor layer may also use a latex polymer having the other functions in combination for the purpose of, for example, regulating the elastic modulus of a film.

The average particle diameter of dispersed particles of the latex polymer used in the receptor layer is preferably 1 to 1,000 nm, particularly preferably 5 to 500 nm.

Examples of the thermoplastic resins used for the latex polymer used in the receptor layer in the present invention include polycarbonates, polyesters, polyacrylates, polyvinyl chloride, vinyl chloride-series copolymers, polyurethane, styrene-acrylonitrile copolymers, styrene-acryl copolymers, polycaprolactone and the like. Among them, polyesters, polyacrylate, styrene-acryl copolymers, polyvinyl chloride, and vinyl chloride-series copolymers are preferable; polyesters, polyvinyl chloride and vinyl chloride-series copolymers are more preferable; polyvinyl chloride, vinyl chloride-series copolymers are furthermore preferable; and vinyl chloride-series copolymers are most preferable.

In the present specification, the vinyl chloride-series copolymer is a copolymer containing a vinyl chloride component as a polymer constituting component, and a copolymer prepared with vinyl chloride as a polymerization monomer and other monomers, and preferable examples thereof include a vinyl chloride-vinyl acetate copolymer, a vinyl chloride-acrylate copolymer, a vinyl chloride-methacrylate copolymer, and a vinyl chloride/acrylate/ethylene copolymer. As described above, the copolymer may be a binary copolymer or a ternary or higher copolymer, and the monomers may be distributed randomly or uniformly by block copolymerization.

In the present invention, among vinyl chloride-series copolymers, a vinyl chloride-acrylate copolymer is preferable.

In these copolymers, an auxiliary monomer component such as a vinyl alcohol derivative, a maleic acid derivative, or a vinyl ether derivative may be added.

It is preferable that the vinyl chloride-series copolymer used in the present invention contains vinyl chloride as a main component. The term "contain vinyl chloride as a main component" means that the vinyl chloride component is contained at a proportion of 50% by mole or more, and it is preferable that the vinyl chloride component is contained at a proportion of 50% by mole or more, while an auxiliary monomer components such as a maleic acid derivative, or a vinyl ether derivative is contained at a proportion of 10% by mole or less.

In the present invention, the latex polymer used in the receptor layer may be used singly or as a mixture of two or more kinds thereof. The latex polymer used in the receptor layer may have a uniform structure or a core/shell structure, and in the latter case, the resins constituting the core and the shell, respectively, may have different glass transition temperatures.

In the present invention, the glass transition temperature (Tg) of the latex polymer used in the receptor layer is preferably −30° C. to 100° C., more preferably 0° C. to 90° C., furthermore preferably 20° C. to 90° C., and particularly preferably 40° C. to 90° C.

The glass transition temperature (Tg), if not practically measurable, may be calculated according to the following formula:

$$1/Tg=\Sigma(Xi/Tgi)$$

wherein, assuming that the polymer is a homopolymer or copolymer composed of n monomers from i=1 to i=n; Xi is a mass fraction of the i-th monomer ($\Sigma Xi=1$); Tgi is a glass transition temperature (measured in absolute temperature) of a homopolymer formed from the i-th monomer; and the symbol $\Sigma$ means the sum of i=1 to i=n. The value of the glass transition temperature of a homopolymer formed from each monomer (Tgi) can be adopted from J. Brandrup and E. H. Immergut, "Polymer Handbook, 3rd. Edition", Wiley-Interscience (1989).

The latex polymer preferably used in the present invention is such that the polymer concentration is preferably 10 to 70% by mass, and more preferably 20 to 60% by mass, based on the latex liquid. The total addition amount of the latex polymer in the receptor layer is such that the solid content of the latex polymer is preferably 50 to 98% by mass, and more preferably 70 to 95% by mass, based on the total amount of the polymer in the receptor layer.

As a preferable embodiment of the latex polymer, latex polymers such as acrylic-series polymers; polyesters; rubbers (e.g., SBR resins); polyurethanes; polyvinyl chloride copolymers including copolymers such as vinyl chloride/vinyl acetate copolymer, vinyl chloride/acrylate copolymer, and vinyl chloride/methacrylate copolymer; polyvinyl acetate copolymers including copolymers such as ethylene/vinyl acetate copolymer; and polyolefins; are preferably used. These latex polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number-average molecular weight.

The latex polymer used in the present invention is preferably exemplified by polyester latex, or any one of vinyl chloride latex copolymers such as vinyl chloride/acrylic compound latex copolymer, vinyl chloride/vinyl acetate latex copolymer, and vinyl chloride/vinyl acetate/acrylic compound latex copolymer, or arbitrary combinations thereof.

Examples of the vinyl chloride-series latex copolymer include VINYBLAN 240, VINYBLAN 270, VINYBLAN 276, VINYBLAN 277, VINYBLAN 375, VINYBLAN 380, VINYBLAN 386, VINYBLAN 410, VINYBLAN 430, VINYBLAN 432, VINYBLAN 550, VINYBLAN 601, VINYBLAN 602, VINYBLAN 609, VINYBLAN 619, VINYBLAN 680, VINYBLAN 680S, VINYBLAN 681N, VINYBLAN 683, VINYBLAN 685R, VINYBLAN 690, VINYBLAN 860, VINYBLAN 863, VINYBLAN 685, VINYBLAN 867, VINYBLAN 900, VINYBLAN 938 and VINYBLAN 950 (trade names, manufactured by Nissin Chemical Industry Co., Ltd.); and SE1320, S-830 (trade names, manufactured by Sumika Chemtex Compony, Limited). In the present invention, these are preferable latex polymers.

The latex polymer other than the vinyl chloride-series latex copolymer may include a polyester-series latex polymer. The polyester-series latex polymer is exemplified by Vylonal MD1200, Vylonal MD1220, Vylonal MD1245, Vylonal MD1250, Vylonal MD1500, Vylonal MD1930, and Vylonal MD1985 (trade names, manufactured by Toyobo Co., Ltd.).

Among them, vinyl chloride copolymer latexes such as a vinyl chloride/acrylic compound copolymer latex (particularly, a vinyl chloride/acrylic acid ester copolymer latex), a vinyl chloride/vinyl acetate copolymer latex, and a vinyl chloride/vinyl acetate/acrylic compound copolymer latex (particularly, a vinyl chloride/vinyl acetate/acrylic acid ester copolymer latex) are particularly preferred, and a vinyl chloride/acrylic compound copolymer latex is most preferred. In the present invention, it is also preferable to use the latexes in combination of two or more kinds thereof.

In the present invention, in the case where the latex polymer is used in combination of two or more kinds thereof, it is preferable that at least two kinds of the latex polymers are all selected from a vinyl chloride/acrylic acid ester copolymer and a vinyl chloride homopolymer.

In the case where the heat-sensitive transfer image-receiving sheet has two receptor layers, it is preferable that all of these receptor layers contain the respective latexes of vinyl chloride and a vinyl chloride-series copolymer, and it is also preferable that the resin contained in the upper receptor layer has a higher glass transition temperature (Tg) than that of the resin contained in the lower receptor layer (receptor layer on the support side).

(Water-soluble Polymer)

The image-receiving sheet in the present invention may contain a water-soluble polymer in the receptor layer. A gelatin, a polyvinyl alcohol, a polyvinylpyrrolidone, and polyvinylpyrrolidone copolymers are preferably used. Among them, a gelatin is preferably used, for the reason that a gelatin has good setting property at the time of coating. However, in the present invention, a water-soluble polymer other than a gelatin is preferably used, and a polyvinylpyrrolidone and a polyvinylpyrrolidone copolymer are preferable. These water-soluble polymers are effective in controlling hydrophilicity and hydrophobicity of the receptor layer, and in the case where the water-soluble polymer is used in a non-excessive amount, dye transfer from the ink sheet is well, and also, a good transfer density is obtained.

The amount of use of the water-soluble polymer is preferably 0.1 to 10% by mass, and more preferably 0.5 to 5% by mass, relative to the total mass of the solid content in the receptor layer.

(Polyether-modified Silicone)

In the present invention, it is preferable that the receptor layer contains silicone, and it is more preferable that the receptor layer contains a polyether-modified silicone. As the polyether-modified silicone, it is particularly preferable that the receptor layer contains a polyether-modified silicone represented by the following formula (S1).

Formula (S1)

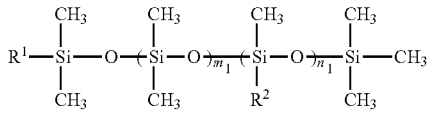

In formula (S1), $R^1$ represents an alkyl group; $R^2$ represents $—X—(C_2H_4O)_{a1}—(C_3H_6O)_{b1}—R^3$; $R^3$ represents a hydrogen atom, an acyl group, a monovalent alkyl group, a monovalent cycloalkyl group, or a monovalent aryl group; X represents an alkylene group or an alkyleneoxy group; $m_1$ and $n_1$ each independently represent a positive integer; $a_1$ represents a positive integer; and $b_1$ represents 0 or a positive integer.

The alkyl group represented by $R^1$ may represent a branched alkyl group. The alkyl group represented by $R^1$ is preferably an alkyl group having 1 to 20 carbon atoms, more preferably 1 to 8 carbon atoms, still more preferably 1 to 4 carbon atoms. Among them, a methyl group and an ethyl group are preferable and a methyl group is most preferable.

The acyl group having an acyl moiety represented by $R^3$ includes, for example, an acetyl group, a propionyl group, a buthylyl group, and a benzoyl group. Among these acyl groups, an acyl group having 2 to 20 carbon atoms is preferable and an acyl group having 2 to 10 carbon atoms is more preferable.

The monovalent alkyl group represented by $R^3$ includes, for example, a methyl group, an ethyl group, a propyl group, an isopropyl group, a buthyl group, and a tert-buthyl group. The monovalent alkyl group is preferably a monovalent alkyl group having 1 to 20 carbon atoms, more preferably 1 to 10 carbon atoms.

The monovalent cycloalkyl group represented by $R^3$ includes, for example, a cyclopenthyl group and a cyclohexyl group. The monovalent cycloalkyl group is preferably a monovalent cycloalkyl group having 5 to 10 carbon atoms.

The monovalent aryl group represented by $R^3$ includes, for example, a phenyl group and a naphthyl group. An aryl moiety of the monovalent aryl group is preferably a benzene ring.

$R^3$ preferably represents a monovalent alkyl group, preferably a methyl group and a butyl group, particularly preferably a methyl group.

The linking group represented by X is preferably an alkylene group and an alkyleneoxy group. The alkylene group preferably includes, for example, a methylene group, an ethylene group, and a propylene group. The alkyleneoxy group preferably includes, for example, —$CH_2CH_2O$—, —$CH(CH_3)CH_2O$—, —$CH_2CH(CH_3)O$—, and —$(CH_2)_3O$—. The linking group represented by X preferably has 1 to 4 carbon atoms and more preferably 2 or 3.

In addition, X more preferably represents an alkyleneoxy group and particularly preferably a propyleneoxy group (—$(CH_2)_3O$—).

$a_1$ is preferably an integer of 1 or larger, more preferably 1 to 200, and furthermore preferably 1 to 100. $b_1$ is preferably 0 or an integer of 1 or larger, more preferably 0 to 200, and furthermore preferably 0 to 100. Further, in order to more effectively exhibit the action of preventing separation lines in high-density image areas, by the present invention, it is more preferable that among the values of $a_1$ and $b_1$, $a_1$ is preferably 30 or larger, more preferably 35 or larger, particularly preferably 40 or larger. Herein, the preferably upper limit of $a_1$ is 100 or less. Both of $a_1$ and $b_1$ are 30 or larger, more preferably 35 or larger, particularly preferably 40 or larger. Herein, the preferably upper limit of each of $a_1$ and $b_1$ is 100 or less.

In order to more effectively exhibit the effects of the present invention, $m_1$ is preferably 10 to 500, more preferably 30 to 300, and most preferably 50 to 200.

$n_1$ is preferably 1 to 50, and more preferably 1 to 20.

The polyether-modified silicone preferably has an average molecular weight of 55,000 or less, and more preferably 40,000 or less. The term "average molecular weight" in the present invention means a mass average molecular weight. The mass average molecular weight used herein is a molecular weight obtained by measuring a molecular weight with a GPC analyzer using columns of TSKgel GMH×L, TSKgel G4000H×L and TSKgel G2000H×L (trade names, manufactured by Tosoh Corporation) and then converting the measured value using polystyrene as a reference material; the solvent used for GPC is THF and the detection is conducted by a differential refractometer.

It is preferable that the polyether-modified silicone is a liquid at 25° C. The viscosity of the polyether-modified silicone is preferably from 500 mPa·s to 10,000 mPa·s, more preferably from 1,000 mPa·s to 5,000 mPa·s, and furthermore preferably from 2,000 mPa·s to 5,000 mPa·s. The methods of measuring the viscosity may be roughly classified into a method of measuring a resistance force exerted to a rotating body in a liquid and a method of measuring a pressure loss occurring when the liquid is passed through an orifice or a capillary. The former method involves a rotary type viscometer, which is represented by a B type viscometer. The latter method involves a capillary viscometer, which is represented by an Ostwald viscometer. In the present invention, the viscosity is defined as a value measured with the B type viscometer at a temperature of 25° C.

The HLB (Hydrophile-Lipophile-Balance) value of the polyether-modified silicone represented by formula (S1) is preferably 4.0 to 8.0, and particularly preferably 4.5 to 6.5. If the HLB value is too low, failure in the surface state is likely to occur. If the HLB value is too high, the ability of preventing the generation of separation lines is decreased.

In the present invention, the HLB value is determined by a calculation formula defined by the following expression, according to the Griffin's method ("Kaimennkasseizaibinnrann (Handbook of Surfactant)," co-authored by Ichiro Nishi, Tooziro Imai and Masai Kasai, published by Sangyo Tosho Co., Ltd., 1960).

$$HLB=20\times Mw/M$$

Herein, M represents a molecular weight, and Mw represents a formula weight (molecular weight) of a hydrophilic moiety. In addition, M=Mw+Mo, in which Mo is a formula weight (molecular weight) of a lipophilic moiety. The hydrophilic moiety in this case is an alkyleneoxy group.

Specific examples of the polyether-modified silicone oil preferably used in the present invention include KF-351A, KF-352A, KF-353, KF-354L, KF-355A, KF-615A, KF-945, KF-640, KF-642, KF-643, KF-6020, KF-6011, KF-6012, KF-6015, KF-6017, X-22-4515, and X-22-6191, manufactured by Shin-Etsu Chemical Co., Ltd.; SH3749, SH3773M, SH8400, SF8427, SF8428, FZ-2101, FZ-2104, FZ-2110, FZ-2118, FZ-2162, FZ-2203, FZ-2207, FZ-2208, FZ-77, L-7001, and L-7002, manufactured by Dow Corning Toray Co., Ltd. (all trade names).

The polyether-modified silicone oil preferably used in the present invention can be easily synthesized by the methods described in, for example, JP-A-2002-179797, JP-A-2008-1896, and JP-A-2008-1897, or methods equivalent to these methods.

In the present invention, the polyether-modified silicone oil can be used singly, or in combination of two or more kinds thereof. Further, in the present invention, a releasing agent may be used, in addition to the polyether-modified silicone oil.

The addition amount of the polyether-modified silicone oil is preferably 1% by mass to 20% by mass (solid content %), and more preferably 1% by mass to 10% by mass (solid content %), to the total amount of the latex polymer in the receptor layer.

The coating amount of the receptor layer in the present invention is preferably 0.5 to 10.0 g/$m^2$, and more preferably 1.0 to 8.0 g/$m^2$. The term "coating amount" in the present specification is a value calculated in terms of the solid content, unless particularly stated otherwise.

(Surfactant)

In the present invention, it is preferable that the receptor layer contains a surfactant. The surfactant is preferably an anionic surfactant or a nonionic surfactant, and is more preferably an anionic surfactant.

Among the anionic surfactants, it is more preferable that the receptor layer contains at least one anionic surfactant represented by the following formula (A1) or (A2). In order to greatly exhibit the effects of the present invention, the anionic surfactant is particularly preferably a compound represented by the following formula (A1).

Formula (A1)

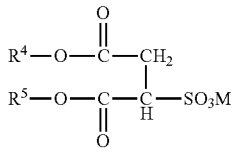

In formula (A1), $R^4$ and $R^5$ each independently represents an alkyl group having 3 to 20 carbon atoms, preferably an alkyl group having 4 to 10 carbon atoms, and more preferably a branched alkyl group having 4 to 10 carbon atoms. Both of $R^4$ and $R^5$ particularly preferably are a 2-ethylhexyl group.

In formula (A1), M represents a hydrogen atom or a cation. Preferable examples of the cation represented by M include an alkali metal ion (e.g., a lithium ion, a sodium ion, a potassium ion), an alkaline-earth metal ion (e.g., a barium ion, a calcium ion), and an ammonium ion. Among these, a lithium ion, a sodium ion, a potassium ion and an ammonium ion are more preferable; and a lithium ion, a sodium ion and a potassium ion are furthermore preferable.

Formula (A2)

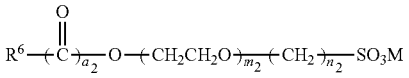

In formula (A2), $R^6$ represents an alkyl group or an alkenyl group, each having 6 to 20 carbon atoms; preferably an alkyl group or an alkenyl group, each having 10 to 20 carbon atoms; and most preferably an alkyl group or an alkenyl group, each having 14 to 20 carbon atoms.

$R^6$ may represent a branched, alkyl or alkenyl group.

In formula (A2), M represents a hydrogen atom or a cation. Preferable examples of the cation represented by M include an alkali metal ion (e.g., a lithium ion, a sodium ion, a potassium ion), an alkaline-earth metal ion (e.g., a barium ion, a calcium ion), and an ammonium ion. Among these, a lithium ion, a sodium ion, a potassium ion and an ammonium ion are more preferable; and a lithium ion, a sodium ion and a potassium ion are furthermore preferable.

$m_2$ represents an average number of added moles, and is preferably larger than 0 and equal to or less than 10. $m_2$ is more preferably 1 to 6, and most preferably 2 to 4.

$n_2$ represents an integer from 0 to 4, and is particularly preferably 2 to 4.

$a_2$ represents 0 or 1, and is particularly preferably 0.

Specific examples of the compound are described below. However, the anionic surfactant used in the present invention is not limited thereto.

A1-1

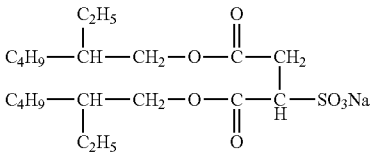

A1-2

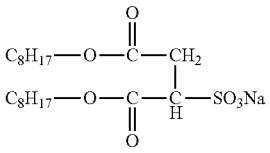

A1-3

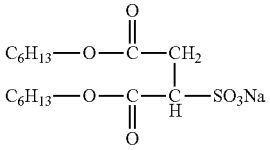

A1-4

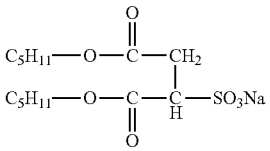

-continued

A1-5

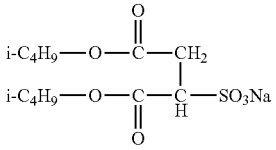

A1-6

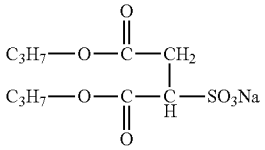

A1-7

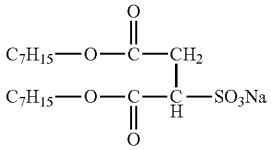

A1-8

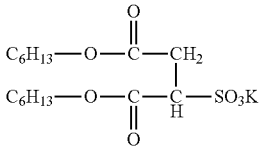

A1-9

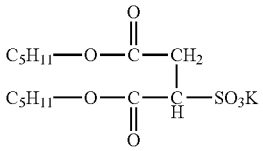

A1-10

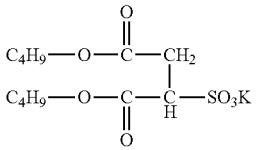

A2-1

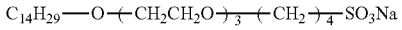

A2-2

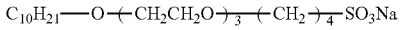

A2-3

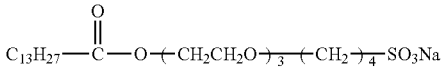

A2-4

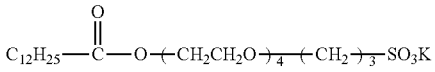

A2-5

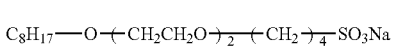

A2-6

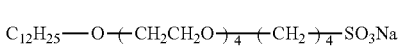

A2-7

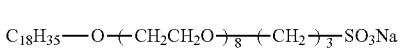

The anionic surfactant represented by formula (A1) and the anionic surfactant represented by (A2) not only contribute to stabilization of the surface state by imparting wettability to a coating liquid, but also suppresses the generation of separation lines in the high-density image areas by using in combination with the polyether-modified silicone represented by formula (S1). The anionic surfactant also has an effect of preventing gloss unevenness.

The anionic surfactant represented by formula (A1) and the anionic surfactant represented by formula (A2) may be incorporated into any layer such as a heat insulation layer or an intermediate layer, in addition to the receptor layer.

The total coating amount of the anionic surfactant represented by formula (A1) and the anionic surfactant represented by formula (A2) is preferably from 5 mg/m$^2$ to 500 mg/m$^2$, and more preferably from 10 mg/m$^2$ to 200 mg/m$^2$.

Furthermore, in the present invention, in addition to the anionic surfactant represented by formula (A1) and the anionic surfactant represented by formula (A2), other various surfactants such as anionic, nonionic and cationic surfactants may also be used in combination in the receptor layer.

An example of the other surfactants preferably used in combination with the anionic surfactant represented by formula (A1) and the anionic surfactant represented by formula (A2) is a fluorine-containing compound represented by the following formula (H).

Formula (H)

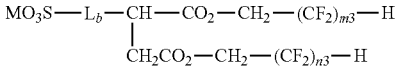

In formula (H), $m_3$ and $n_3$ each independently represents an integer of 2 to 8, preferably 2 to 6, more preferably 3 to 6. The total value of $m_3$ and $n_3$ is preferably 6 to 12, more preferably 6 to 10. Among them, $m_3$ and $n_3$ are preferably the same from each other, and most preferably $m_3$ and $n_3$ each are 4.

Preferable examples of the cation represented by M include an alkali metal ion (e.g., a lithium ion, a sodium ion, a potassium ion), an alkaline-earth metal ion (e.g., a barium ion, a calcium ion), and an ammonium ion. Among these, a lithium ion, a sodium ion, a potassium ion and an ammonium ion are more preferable; and a lithium ion, a sodium ion and a potassium ion are furthermore preferable.

$L_b$ represents an alkylene group, which is a single bond. In the case where $L_b$ represents an alkylene group, the alkylene group is preferably an alkylene group having 2 or less carbon atoms, more preferably a methylene group. It is the most preferable that $L_b$ is a single bond.

It is preferable to combine the above preferable embodiments from each other in formula (H).

The specific examples of the compound represented by formula (H) are described below. However, the compound represented by formula (H) that can be used in the present invention is not limited thereto. In the following descriptions on the structure of the example compounds, unless particularly stated otherwise, the alkyl group and perfluoroalkyl group mean groups having a linear structure.

(H)-1

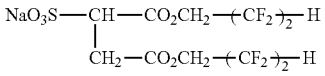

(H)-2

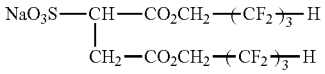

(H)-3

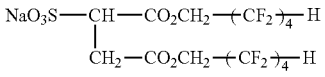

-continued (H)-4

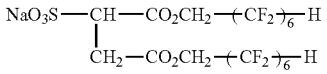

(H)-5

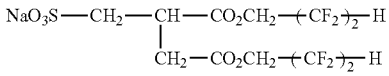

(H)-6

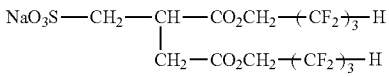

(H)-7

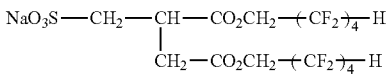

(H)-8

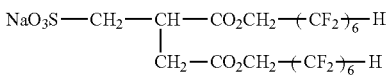

(H)-9

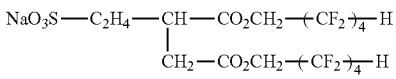

(H)-10

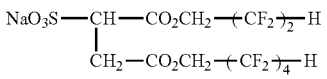

(H)-11

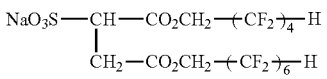

The coating amount of the fluorine-containing compound represented by formula (H) is preferably from 0.5 mg/m$^2$ to 50 mg/m$^2$ and more preferably from 1 mg/m$^2$ to 20 mg/m$^2$ in the layer to which the compound is added.

(Other Additive)

The receptor layer in the present invention may contain an additive, according to the necessity. Examples of the additive include an ultraviolet absorbent, an antiseptic agent, a film-forming aid, a film-hardening agent, a matting agent (including a lubricating agent), an antioxidizing agent, and other additives.

(Ultraviolet Absorbent)

The heat-sensitive transfer image-receiving sheet in the present invention may contain an ultraviolet absorbent. As the ultraviolet absorbents, typical inorganic or organic ultraviolet absorbents are used. As the organic ultraviolet absorbents, non-reactive ultraviolet absorbents such as salicylate-series, benzophenone-series, benzotriazole-series, triazine-series, substituted acrylonitrile-series, and hindered amine-series ultraviolet absorbents; copolymers or graft polymers of thermoplastic resins (e.g., acrylic resins) obtained by introducing, for example, an addition-polymerizable double bond (e.g., a vinyl group, an acryloyl group, a methacryloyl group), or an alcoholic hydroxyl group, an amino group, a carboxyl group, an epoxy group, or an isocyanate group, to the non-reactive ultraviolet absorbents, subsequently copolymerizing or grafting can be used. In addition, a method is disclosed, in which ultraviolet absorbents are dissolved in a monomer or oligomer of the resin and then the monomer or oligomer is polymerized (JP-A-2006-21333), and the ultraviolet-shielding resins obtained by this method can be used. In this case, the ultraviolet absorbents may be non-reactive.

Among these ultraviolet absorbents, benzophenone-series, benzotriazole-series, and triazine-series ultraviolet absorbents are particularly preferable. It is preferable that these ultraviolet absorbents are used in combination thereof, so as to cover an effective ultraviolet absorption wavelength region, according to the property of a dye used in an image formation. In addition, in the case of the non-reactive ultraviolet absorbents, it is preferable to use a mixture of two or more kinds of ultraviolet absorbents each having a different structure from each other, so as to prevent the ultraviolet absorbents from precipitating.

Examples of commercially available ultraviolet absorbents include TINUVIN-P (trade name, manufactured by Ciba-Geigy), JF-77 (trade name, manufactured by JOHOKU CHEMICAL Co., Ltd.), SEESORB 701 (trade name, manufactured by SHIRAISHI CALCIUM KAISHA, Ltd.), SUMISORB 200 (trade name, manufactured by Sumitomo Chemical Co., Ltd.), VIOSORB 520 (trade name, manufactured by KYODO CHEMICAL Co., Ltd.), and ADKSTAB LA-32 (trade name, manufactured by ADEKA).

(Antiseptic)

To the heat-sensitive transfer image-receiving sheet in the present invention, an antiseptic may be added. The antiseptic that may be contained in the image-receiving sheet in the present invention is not particularly limited. For example, materials, described in Bofubokabi (Preservation and Antifungi) HAND BOOK, Gihodo shuppan (1986), Bokin Bokabi no Kagaku (Chemistry of Anti-bacteria and Antifungi) authored by Hiroshi Horiguchi, Sankyo Shuppan (1986), Bokin Bokabizai Jiten (Encyclopedia of Antibacterial and Antifungal Agent) edited by The Society for Antibacterial and Antifungal Agent, Japan (1986), can be used. Specific examples thereof include an imidazole derivative, sodium dehydroacetate, a 4-isothiazoline-3-on derivative, benzoisothiazoline-3-on, a benzotriazole derivative, an amidineguanidine derivative, quaternary ammonium salts, derivatives of pyrrolidine, quinoline, guanidine, or the like, diazine, a triazole derivative, oxazole, an oxazine derivative, and 2-mercaptopyridine-N-oxide or its salt. Among them, a 4-isothiazoline-3-on derivative and benzoisothiazoline-3-on are preferable.

(Film-forming Aid)

It is preferable to add a high boiling point solvent to the heat-sensitive transfer image-receiving sheet in the present invention. The high boiling point solvent is an organic compound (typically, an organic solvent) which functions as a film-forming aid or a plasticizer, and lowers the lowest film-forming temperature of the latex polymer, and such solvents are described in, for example, "Gosei Latex no Kagaku (Chemistry of Synthetic Latex)", Soichi Muroi, issued by Kobunshi Kanko Kai (1970). Examples of the high boiling point solvent (film-forming aid) include the following compounds.

Z-1: Benzyl alcohols

Z-2: 2,2,4-Trimethylpentanediol-1,3-monoisobutyrates

Z-3: 2-Dimethylaminoethanols

Z-4: Diethylene glycols

When these high boiling point solvents are added to the image-receiving sheet, loss of definition of image is observed, and there is an undesirable case for practical use. However, if the solid content of the solvents in the coating film is not too large, there is no problem in terms of performance.

(Hardening Agent)

The heat-sensitive transfer image-receiving sheet in the present invention may contain a hardening agent (hardener). The hardening agent may be added to a coated layer(s) of the heat-sensitive transfer image-receiving sheet.

Preferable examples of the hardener that can be used in the present invention include H-1, 4, 6, 8 and 14 on page 17 of JP-A-1-214845; compounds (H-1 to H-54), respectively, represented by any one of formulae (VII) to (XII) in columns 13 to 23 of U.S. Pat. No. 4,618,573; compounds (H-1 to H-76), respectively, represented by formula (6) in the lower right on page 8 of JP-A-2-214852, (particularly, H-14); and compounds described in claim 1 of U.S. Pat. No. 3,325,287. Examples of the hardening agent include hardening agents described, for example, in column 41 of U.S. Pat. Nos. 4,678,739, 4,791,042, JP-A-59-116655, JP-A-62-245261, JP-A-61-18942, and JP-A-4-218044. More specifically, an aldehyde-series hardening agent (e.g. formaldehyde), an aziridine-series hardening agent, an epoxy-series hardening agent, a vinyl sulfone-series hardening agent (e.g. N,N'-ethylene-bis(vinylsulfonylacetamido)ethane), an N-methylol-series hardening agent (e.g. dimethylol urea), a boric acid, a metaboric acid, or a polymer hardening agent (compounds described, for example, in JP-A-62-234157), can be exemplified. Preferable examples of the hardener include a vinyl sulfone-series hardener and chlorotriazines.

(Matting Agent)

To the heat-sensitive transfer image-receiving sheet in the present invention, a matting agent may be added, in order to prevent blocking, or to give a release property or a sliding property. The matting agent may be added to the side of the image-receiving sheet, to which the receptor layer is coated. In detail, the matting agent may be added to the receptor layer, a white layer, a heat transferable protective layer, and the like.

Examples of the matting agent generally include fine particles of water-insoluble organic compounds and fine particles of inorganic compounds. In the present invention, the organic compound-containing fine particles are preferably used from the viewpoints of dispersion property. In so far as the organic compound is incorporated in the particles, there may be organic compound particles consisting of the organic compound singly, or alternatively organic/inorganic composite particles containing not only the organic compound but also an inorganic compound. As the matting agent, there can be used organic matting agents described in, for example, U.S. Pat. Nos. 1,939,213, 2,701,245, 2,322,037, 3,262,782, 3,539,344, and 3,767,448.

[Method of Producing Receptor Layer]

Hereinafter, the method of producing the receptor layer in the present invention is explained.

The receptor layer in the present invention is preferably an aqueous type coating layer. Herein, the term "aqueous type" means that 60% by mass or more of a solvent (dispersion medium) of a coating liquid is water. As a component other than water in the coating liquid, an organic solvent miscible with water may be used. Examples thereof include methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

In the case of coating two or more receptor layers and other functional layers on the subbing layer of the transparent support, it has been known to produce the layers by sequentially coating each of the layers over and over, or by coating each of the layers in advance on the support and adhering the assemblies, as disclosed in JP-A-2004-106283, JP-A-2004-181888, JP-A-2004-345267, and the like. On the other hand, it has been known, in photographic industries, that productivity can be greatly improved, for example, by providing plural layers through simultaneous multi-layer coating. For example, there are known methods, such as the so-called slide coating (slide coating method) and curtain coating (curtain coating method), as described in, for example, U.S. Pat. Nos. 2,761,791, 2,681,234, 3,508,947, 4,457,256 and 3,993,019; JP-A-63-54975, JP-A-61-278848, JP-A-55-86557, JP-A-52-

31727, JP-A-55-142565, JP-A-50-43140, JP-A-63-80872, JP-A-54-54020, JP-A-5-104061, JP-A-5-127305, and JP-B-49-7050 ("JP-B" means examined Japanese patent application); and Edgar B. Gutoff, et al., "Coating and Drying Defects: Troubleshooting Operating Problems", John Wiley & Sons, 1995, pp. 101-103. According to these coating methods, two or more kinds of coating liquids are fed simultaneously into a coating apparatus and formed into two or more different layers.

The method of producing the receptor layer in the present invention is preferably carried out by the slide coating or the curtain coating. Even in the case of coating plural layers, coating of these layers can be carried out by the simultaneous multilayer-coating and high productivity can be realized, by these coating methods.

Herein, in the case of conducting the simultaneous multilayer-coating, it is necessary to adjust the viscosity and surface tension of the coating liquid, from the viewpoint of forming a uniform coating film and obtaining a satisfactory coatability. The viscosity of the coating liquid can be easily adjusted by using usual thickeners or viscosity reducers in such a degree that they do not affect to other performances. Further, the surface tension of the coating liquid can be adjusted by using various kinds of surfactants.

The temperature of these coating liquids for coating various layers is preferably 25° C. to 60° C., and more preferably 30° C. to 50° C. Particularly, the temperature of the coating liquids in the case of using gelatin in the coating liquid is preferably 33° C. to 45° C.

In the present invention, the coating amount of the coating liquid for a layer is preferably in the range of 1 g/m$^2$ to 500 g/m$^2$. The number of layers in the multilayer constitution can be arbitrarily selected to be two or more. It is preferable that the receptor layer is provided as a layer disposed farthest from the support.

In a drying zone, drying proceeds through: the constant rate period of drying, in which the drying rate is constant, and the material temperature is approximately equal to a wet-bulb temperature; and a falling rate period of drying, in which the drying rate are slowed, and the material temperature rises. In the constant rate drying period, any heat supplied from an external source is all used in the evaporation of moisture. In the falling rate drying period, moisture diffusion inside the material becomes rate-limiting, and the drying rate is lowered due to recession of the evaporation surface or the like. The supplied heat is used in the rising of the material temperature.

In a setting zone and the drying zone, moisture migration occurs between the respective coated films (coated layers) and between the support and the coated films, and solidification also occurs due to cooling of the coated films and moisture evaporation. For these reasons, the quality and performance of the resultant product is greatly influenced by the processing history, such as the layer surface temperature during drying and the drying period of time, and it is required to set the conditions in accordance with the demanded quality.

The temperature of the setting zone is 15° C. or below, and it is preferable to set the cooling step time period in the range from 5 seconds or more to less than 30 seconds. If the cooling time period is too short, a sufficient increase of the coating liquid viscosity cannot be obtained, and the surface state is deteriorated upon the subsequent drying step. On the other hand, if the cooling time period is too long, the removal of moisture in the subsequent drying step takes time, and the production efficiency is decreased.

After the cooling step at 15° C. or below, drying is carried out in an environment at above 15° C. In this case, in the present invention, it is preferable to adjust the amount of evaporation of water in the coated films that have been coated by multilayer-coating within 30 seconds after the completion of cooling, to 60% or more of the amount of moisture contained at the layer surface smeared per an area of 1 m$^2$ immediately after coating. The terms "amount of moisture contained at the layer surface smeared per an area of 1 m$^2$ immediately after coating", is equal to the water content in the coating liquid prepared before the coating. When the amount of evaporating moisture is not so small, moisture is present on the coated surface not in excess, and the surface state is satisfactory. On the other hand, in the case of adjusting the amount of evaporation to 60% or more, when the drying temperature is set to a temperature not so higher than 50° C., the evaporation of moisture does not occur rapidly, without causing cracking or the like, and the surface state is satisfactory. Thus, it is preferable to control the drying temperature to 50° C. or below.

Determination of the amount of evaporation can be carried out such that the mass obtained by drying the heat-sensitive transfer image-receiving sheet after coating under the condition (atmosphere) of 110° C. for one hour, is defined as the mass after 100% of moisture is evaporated, and the difference between the masses before and after drying are measured.

Furthermore, from the viewpoint of enhancing the scratch resistance of the receptor layer, it is preferable to form the receptor layer by carrying out the final drying step under an environment at a temperature of 120° C.

The coat-finished product which has been dried is adjusted to have a certain water content, followed by winding up. Since the progress of film hardening is affected by the water content and temperature during the storage of the wound, coat-finished product, it is necessary to set the conditions for humidification step that are appropriate for the water content in the wound-up state.

In general, a film-hardening reaction can be carried out more easily at high temperature and high humidity conditions. However, if the water content is too high, adhesion between the coated products may occur, or there may be a problem in terms of performance. For this reason, it is necessary to set the water content in the wound-up state (humidification conditions) and the storage condition in accordance with the product quality.

Typical drying devices include an air-loop system, a helical system, and the like. The air-loop system, is a system in which drying blasts are made to blow on the coat-finished product supported by a roller and a duct may be mounted either longitudinally or transversely. Such a system has a high degree of freedom in setting of the volume of drying wind or the like, since a drying function and a transporting function are basically separated therein. However, many rollers are used therein, so base-transporting failures, such as gathering, wrinkling, and slipping, tend to occur. The helical system is a system, in which the coat-finished product is wound round a cylindrical duct in a helical fashion, and is transported and dried while it is floated by drying wind (air floating). So no support by rollers is basically required (JP-B-43-20438). In addition, there is a drying system, in which the coated-finished product is conveyed by reciprocally installing upper and lower ducts. In general, this system has a better dryness distribution than that of the helical system, but is poor in floatability.

[Method of Measuring Spherical Indenter Hardness]

In the present invention, a spherical indenter hardness, after the subbing layer and the receptor layer are provided on the transparent support of the heat-sensitive transfer image-receiving sheet, is less than that of the transparent support itself. As an indicator of hardness, an automatic micro-Vickers hardness testing system (trade name: HMV-FA, manufactured by Shimadzu Corporation) is used, in which the Vickers indenter is changed to a spherical indenter having a diameter of 0.2 mm, and the indenter is put on a sample and then the sample is subjected to weight bearing of 200 mN over a period of 10 seconds, and thereafter the weight is reduced to 0 over a period of 10 seconds. A maximum amount of displacement (μm) of the sample at this time is measured. The less the amount of displacement, the higher the hardness is.

In the present invention, the maximum amount of displacement (μm) of the heat-sensitive transfer image-receiving sheet is preferably 3.0 μm to 5.0 μm, more preferably 3.0 μm to 4.0 μm The spherical indenter hardness, after the subbing layer and the receptor layer are provided on the transparent support of the heat-sensitive transfer image-receiving sheet, may be adjusted by installment of the subbing layer and the adhesion resin layer for adhering the subbing layer to the transparent support, materials that are used in these layers, and materials that are used in the receptor layer. These layers and the transparent support are described above, and such adjustment may be achieved by combining preferable layers or the like among them.

<Heat-sensitive Transfer Sheet>

In the heat-sensitive transfer image-receiving sheet in the present invention, the dye is transferred by the heat-sensitive transfer sheet to form an image, and then a white layer (white transfer layer) is transferred. The heat-sensitive transfer sheet in the present invention preferably has a dye transfer barrier layer containing at least one kind of a water-soluble polymer or at least one kind of inorganic particles between a support and a dye layer.

The heat-sensitive transfer sheet for transferring the dye and the heat-sensitive transfer sheet for transferring the white layer may be an integrated sheet or may be separate sheets. It is also acceptable to transfer a heat transferable protective layer after the white layer is transferred.

The integrated heat-sensitive transfer sheet is a sheet obtained by providing (forming), in area order, on a support such as polyethylene terephthalate (PET), dye layers (colorant layers) prepared by dispersing dyes of three colors, such as yellow, magenta, and cyan, respectively, in a binder resin, and a white layer. In the case of the separate sheets, for the sheet for dye transfer, use is made of a sheet obtained by providing, in area order, on the support described above, dye layers prepared by dispersing dyes of three colors, such as yellow, magenta, and cyan, respectively, in the binder resin, while for the sheet for the white layer transfer, a sheet obtained by providing the white layer on the support described above is used.

The term "forming layers in area order" as used in the present specification means forming dye layers each having a different hue and/or function layers in the longitudinal direction on the support of the heat-sensitive transfer sheet, by applying them separately in order.

Examples include the case in which a yellow dye layer, a magenta dye layer, and a cyan dye layer are formed in this order in the longitudinal direction on the support.

Further, any arrangement of these dye layers can be employed, but it is preferred that a yellow dye layer, a magenta dye layer, and a cyan dye layer be arranged sequentially in this order on the support.

Herein, with respect to the dye transfer, an embodiment, in which the dye layers are constituted of four colors, including black in addition to the three colors, is also acceptable.

In the case of transferring the heat transferable protective layer, in the integrated heat-sensitive transfer sheet, the heat-transferable protective layer may be provided after providing the white layer. In the case of the separate sheets, the heat transferable protective layer may be provided, in area order, on the heat sensitive transfer sheet provided with the white layer, or a sheet having the heat transferable protective layer provided on another sheet may be used.

Further, in the integrated heat-sensitive transfer sheet, the heat-transferable protective layer may be provided before providing the white layer. In the case of the separate sheets, a heat-sensitive transfer sheet obtained by providing the respective dye layers of three colors of yellow, magenta, and cyan, and the heat-transferable protective layer in area order, and the heat-sensitive transfer sheet provided with the white layer may be combined. In this case, the heat transferable protective layer is formed on the receptor layer, and the white layer is transferred onto this heat transferable protective layer.

Herein, it is preferable for all of the heat-sensitive transfer sheets to have a heat resistant lubricating layer on the side of the support opposite to the side on which the dye layer, white layer or heat-transferable protective layer is provided.

[Support]

Conventionally known supports can be used as the support. For example, a polyamide film, a polyimide film, and a polyester film are exemplified. Among them, a polyester film is preferable, and examples of the polyester film include polyethylene terephthalate (PET) and polyethylene naphthalate (PEN), and polyethylene terephthalate is preferable.

The thickness of the support can be properly determined in accordance with the material of the support so that the strength, the heat resistance, and the like become appropriate. Specifically, it is preferable to use a support having a thickness of 1 μm to 100 μm, more preferably approximately from 2 μm to 50 μm, and furthermore preferably approximately from 3 μm to 10 μm.

[Dye Transfer Barrier Layer]

The heat-sensitive transfer sheet in the present invention has a dye transfer barrier layer containing at least one kind of a water-soluble polymer or at least one kind of inorganic particles between the support and the dye layer. The dye transfer barrier layer has a role to inhibit penetration of the dye into the support of the heat-sensitive transfer sheet at the time of high-density printing. As a result, efficient transfer of the dye to the heat-sensitive transfer image-receiving sheet is realized.

As an index of the dye transfer barrier layer, the following evaluation can be conducted. That is, a dye at the Dmax section of the heat-sensitive transfer sheet after printing process is removed with methanol, and then the dye having penetrated into a polyester film can be evaluated by absorbance determination of a spectral absorption spectrum. The measurement of spectral absorption spectrum can be performed by utilizing U-3310 (trade name, a spectrophotometer manufactured by Hitachi Ltd.). Herein, it means that the lower absorbance, the less penetration of the dye into the polyester film, which is preferable.

(Water-soluble Polymer)

The water-soluble polymer which can be used in the present invention includes natural polymers (polysaccharide type, microorganism type, and animal type), semi-synthetic polymers (cellulose-based, starch-based, and alginic acid-based), and synthetic polymer type (vinyl type and others); and synthetic polymers including polyvinyl alcohols, and natural or semi-synthetic polymers using celluloses and the like derived from plant as starting materials, as described below.

Among the water-soluble polymers which can be used in the present invention, the natural polymers and the semi-synthetic polymers is explained in detail. Specific examples include the following polymers: plant type polysaccharides such as gum arabics, κ-carrageenans, ι-carrageenans, λ-carrageenans, guar gums (e.g. Supercol, manufactured by Squalon), locust bean gums, pectins, tragacanths, corn starches (e.g. Purity-21, manufactured by National Starch & Chemical Co.), and phosphorylated starches (e.g. National 78-1898, manufactured by National Starch & Chemical Co.); microbial type polysaccharides such as xanthan gums (e.g. Keltrol T, manufactured by Kelco) and dextrins (e.g. Nadex 360, manufactured by National Starch & Chemical Co.); animal type natural polymers such as gelatin (e.g. Crodyne B419, manufactured by Croda), caseins, sodium chondroitin sulfates (e.g. Cromoist CS, manufactured by Croda); cellulose-based polymers such as ethylcelluloses (e.g. Cellofas WLD, manufactured by I.C.I.), carboxymethylcelluloses (e.g. CMC, manufactured by Daicel), hydroxyethyl celluloses (e.g. HEC, manufactured by Daicel), hydroxypropylcelluloses (e.g. Klucel, manufactured by Aqualon), methylcelluloses (e.g. Viscontran, manufactured by Henkel), nitrocelluloses (e.g. Isopropyl Wet, manufactured by Hercules), and cationated celluloses (e.g. Crodacel QM, manufactured by Croda); starches such as phosphorylated starches (e.g. National 78-1898, manufactured by National Starch & Chemical Co.); alginic acid-based compounds such as sodium alginates (e.g. Keltone, manufactured by Kelco) and propylene glycol alginates; and other polymers such as cationated guar gums (e.g. Hi-care 1000, manufactured by Alcolac) and sodium hyaluronates (e.g. Hyalure, manufactured by Lifecare Biomedial) (all of the names are trade names).

Among the natural polymers and the semi-synthetic polymers, a gelatin is preferable. A gelatin having a molecular weight of 10,000 to 1,000,000 may be used. The gelatin may contain an anion such as $Cl^-$ and $SO_4^{2-}$, and may contain a cation such as $Fe^{2+}$, $Ca^{2+}$, $Mg^{2+}$, $Sn^{2+}$, and $Zn^{2+}$. The gelatin is preferably added as an aqueous solution.

Among the water-soluble polymers which can be used in the present invention, the synthetic polymers are explained in detail.

Examples of an acryl type include sodium polyacrylates, polyacrylic acid copolymers, polyacrylamides, polyacrylamide copolymers, and polydiethylaminoethyl(meth)acrylate quaternary salts or their copolymers. Examples of a vinyl type include polyvinylpyrrolidones, polyvinylpyrrolidone copolymers, and polyvinyl alcohols. Examples of the others include polyethylene glycols, polypropylene glycols, polyisopropylacrylamides, polymethyl vinyl ethers, polyethyleneimines, polystyrenesulfonic acids or their copolymers, naphthalenesulfonic acid condensate salts, polyvinylsulfonic acids or their copolymers, polyacrylic acids or their copolymers, acrylic acid or its copolymers, maleic acid copolymers, maleic acid monoester copolymers, acryloylmethylpropanesulfonic acid or its copolymers, polydimethyldiallylammonium chlorides or their copolymers, polyamidines or their copolymers, polyimidazolines, dicyanamide type condensates, epichlorohydrin/dimethylamine condensates, Hofmann decomposed products of polyacrylamides, and water-soluble polyesters (Plascoat Z-221, Z-446, Z-561, Z-450, Z-565, Z-850, Z-3308, RZ-105, RZ-570, Z-730 and RZ-142 (all of these names are trade names), manufactured by Goo Chemical Co., Ltd.).

In addition, highly-water-absorptive polymers, namely, homopolymers of vinyl monomers having —COOM or —$SO_3M$ (M represents a hydrogen atom or an alkali metal atom) or copolymers of these vinyl monomers or these vinyl monomers with other vinyl monomers (for example, sodium methacrylate, ammonium methacrylate, Sumikagel L-5H (trade name) manufactured by Sumitomo Chemical Co., Ltd.) as described in, for example, U.S. Pat. No. 4,960,681 and JP-A-62-245260, may also be used.

Among the water-soluble polymers, with respect to synthetic polymers, polymers having a repeating unit obtained from a polyvinyl alcohol or N-vinylpyrrolidone are preferable Among the water-soluble polymers that can be used in the present invention, polyvinyl alcohols are described in detail below.

Among the polyvinyl alcohols, a polyvinyl alcohol having a sponification ratio of 50 to 100% and a polymerization degree of 200 to 4,000 is preferable. A modified polyvinyl alcohol may be used. With respect to modified polyvinyl alcohols, those described in Koichi Nagano, et al., "Poval", Kobunshi Kankokai, Inc. are used. The modified polyvinyl alcohols include polyvinyl alcohols modified by cations, anions, —SH compounds, alkylthio compounds, or silanols.

Examples of completely saponificated polyvinyl alcohol include PVA-105, PVA-110, PVA-117, PVA-117H, PVA-120, PVA-124, PVA-124H, PVA-CS, PVA-CST, and PVA-HC (all trade names, manufactured by Kuraray Co., Ltd.). Examples of partially saponificated polyvinyl alcohol include PVA-203, PVA-204, PVA-205, PVA-210, PVA-217, PVA-220, PVA-224, PVA-228, PVA-235, PVA-217EE, PVA-217E, PVA-220E, PVA-224E, PVA-403, PVA-405, PVA-420, PVA-613 and L-8 (all trade names, manufactured by Kuraray Co., Ltd.). Examples of such modified polyvinyl alcohols (modified PVA) include C polymers, such as C-118, C-318, C-318-2A, and C-506 (all trade names, manufactured by Kuraray Co., Ltd.); HL polymers, such as HL-12E and HL-1203 (all trade names, manufactured by Kuraray Co., Ltd.); HM polymers, such as HM-03 and HM-N-03 (all trade names, manufactured by Kuraray Co., Ltd.); K polymers, such as KL-118, KL-318, KL-506, KM-118T, and KM-618 (all trade names, manufactured by Kuraray Co., Ltd.); M polymers, such as M-115 (trade name, manufactured by Kuraray Co., Ltd.); MP polymers, such as MP-102, MP-202, and MP-203 (all trade names, manufactured by Kuraray Co., Ltd.); MPK polymers, such as MPK-1, MPK-2, MPK-3, MPK-4, MPK-5, and MPK-6 (all trade names, manufactured by Kuraray Co., Ltd.); R polymers, such as R-1130, R-2105, and R-2130 (all trade names, manufactured by Kuraray Co., Ltd.); and V polymers, such as V-2250 (trade name, manufactured by Kuraray Co., Ltd.).

The viscosity of polyvinyl alcohol can be adjusted or stabilized by adding a trace amount of a solvent or an inorganic salt to an aqueous solution of polyvinyl alcohol, and use may be made of compounds described in the aforementioned reference "Poval", Koichi Nagano et al., published by Kobunshi Kankokai, pp. 144-154. For example, a coated-surface quality can be improved by an addition of boric acid, and the addition of boric acid is preferable. The amount of boric acid to be added is preferably 0.01 to 40 mass %, with respect to polyvinyl alcohol.

Regarding to the water-soluble polymer that can be used in the present invention, the water-soluble polymer having a repeating unit obtained from N-vinylpyrrolidone is described in more detail.

Examples of the water-soluble polymer having a repeating unit obtained from N-vinylpyrrolidone include homopolymers of N-vinylpyrrolidone (polyvinylpyrrolidone, i.e., PVP) and copolymers of N-vinylpyrrolidone and other monomers. Examples of the monomer that is used to synthesize the copolymer include: acrylic acid or a salt thereof; methacrylic acid or a salt thereof; an unsaturated acid monomer such as maleic anhydride; vinyl alcohol; a vinyl or allyl compound having a polyoxyethylene group; styrene; vinyl acetate; an acrylic acid ester; acrylonitrile; butadiene; vinyl chloride, and vinylidene chloride. Among these polymers, polyvinylpyrrolidone, namely PVP is more preferable in the present invention.

As for the polyvinylpyrrolidone resin, although there is no particular limitation in terms of K value according to Fikentscher equation, the K value is preferably in the range of from K15K to K120, and more preferably in the range of from K15K to K80. As for the number average molecular weight, the polyvinylpyrrolidone resin preferably has a range of from approximately 25,000 to about 360,000, and more preferably a range of from approximately 25,000 to 285,000. If the polyvinylpyrrolidone resin with a high-K value (K-120) is used, coating properties tends to become worse.

As for the polyvinylpyrrolidone resin, commercially available products may be used. Examples of thereof include POLYVINYLPYRROLIDONE K-30, K-30W, K-85, K-85W, K-90 and K-90W (trade name, manufactured by NIPPON SHOKUBAI CO., LTD.), PITZCOL K-30, CREEJUS K-30, PITZCOL K-90, CREEJUS K-90 (trade name, manufactured by DAI-ICH KOGYO SEIYAKU CO., LTD.), K-15, K-30, K-60, K-90, K-120 (trade names, manufactured by ISP).

As for a copolymer of N-vinylpyrrolidone and other component(s), commercially available products may be used. Specific examples of the N-vinylpyrrolidone/vinyl acetate copolymer resin include PVP/VA copolymers Grade I-335, I-535, I-635, and I-735 manufactured by ISP; and specific examples of the N-vinylpyrrolidone/styrene copolymer resin include ANTARA430 manufactured by ISP.

In a preferred embodiment, PVP may be crosslinked. As the crosslinked PVP, commercially available ones may be used. Specifically, VIVIPRINT (trade name) 540 manufactured by ISP and the like may be used.

In the present invention, the water-soluble polymer is preferably gelatin, polyvinyl alcohol and polyvinylpyrrolidone, more preferably polyvinyl alcohol and polyvinylpyrrolidone, and most preferably polyvinylpyrrolidone.

Further, the water-soluble polymer may be used in combination of two or more kinds thereof. It is preferable to use water-soluble polymers selected from gelatin, polyvinyl alcohol and polyvinylpyrrolidone in combination. Further, these water-soluble polymers may be cross-linked with a cross-linking agent.

(Inorganic Fine Particle)

Inorganic fine particles that can be used in the present invention are preferably water-dispersible inorganic fine particles. Hitherto known materials may be used as materials of the inorganic fine particles. Examples of these materials include colloidal silica, alumina, colloidal alumina, magnesium silicate, magnesium carbonate, and titanium oxide. Among these materials, colloidal silica, alumina sol, and titanium oxide sol are especially preferred.

Herein, the term "colloidal silica" refers to a dispersion obtained by utilizing water as a main medium, and dispersing ultra-fine particles of anhydrous silicic acid in water. The term "alumina sol" refers to a dispersion obtained by utilizing water as a main medium, and dispersing ultra-fine particles of aluminum oxide in water. The term "titanium oxide sol" refers to a dispersion obtained by utilizing water as a main medium, and dispersing ultra-fine particles of titanium oxide in water.

As for the shape of inorganic fine particles, various kinds of shape such as a needle-like shape, or a tabular shape may be used. The average particle size thereof is preferably from 1 nm to 200 nm, and more preferably from 10 nm to 70 nm. As for these colloidal silica, alumina sol, and titanium oxide sol, commercially available products may be used. Examples of the colloidal silica include SNOWTEX OSX, SNOWTEX XS, SNOWTEX S, and SNOWTEX OS (trade names; colloidal silica manufactured by Nissan Chemical Industries, Ltd.). Examples of the alumina sol include ALUMINA SOL 100, ALUMINA SOL 200 and ALUMINA SOL 520 (trade names; alumina sol manufactured by Nissan Chemical Industries, Ltd.). Further, examples of the titanium oxide sol include TI-NANOXIDE T, TI-NANOXIDE D, TI-NANOXIDE HT (trade names; titanium oxide sol manufactured by Soralonix Corporation), HPW-18NR and HPW-400C (trade names; titanium oxide sol manufactured by Shokubai Kasei Kogyo, K. K.).

Further, the inorganic fine particles may be produced by a synthesis reaction. For example, the titanium oxide film can be prepared by using a polycondensation product of a titanium alkoxide or its partial hydrolyzate, i.e., organotitania sol. As a specific production method, the titanium oxide film can be formed by coating titanium alkoxide or organotitania sol that is a partially hydrolyzated product of titanium alkoxide, and then subjecting the same to a polycondensation reaction by the application of heat.

Herein, the term "titanium alkoxide" means a compound of a titanium atom to which an alkoxide, that is, "—OR" bonds. Such titanium alkoxides are dissolved in an appropriately selected solvent, and then the solution is coated onto a substrate, with supplying steam and heating, according to the necessity. By this, a dye transfer barrier layer composed of titanium alkoxide sol can be formed.

An organotitania sol, prepared by mixing 1 mol of a titanium alkoxide with from 0.5 to 2.0 mol of water, may be mixed with a suitably selected solvent, then applied onto a substrate and heated to form a dye transfer barrier layer composed of titanium alkoxide sol. An acid catalyst or a base catalyst may be added to the coating liquid for the dye transfer barrier layer. The solvent in the coating liquid preferably includes an alcohol such as n-butanol, isopropanol, and the like. The heating temperature is preferably from 110° C. to 150° C.

This is available as commercial products, and examples thereof include alcoxy tetra-i-propoxytitanium (TPT) (trade name A-1, by Nippon Soda), tetra-n-butoxytitanium (TBT) (trade name B-1, by Nippon Soda), tetra-n-butyl titanate dimer, tetraisopropyl titanate, tetrastearyl titanate, tetra-n-butyl titanate, tetraisopropyl titanate 50, triethanolamine titanate (all products by Mitsubishi Gas Chemical), Tyzor TPT, Tyzor TBT (trade names, by DuPont), and the like.

It is enough that the dye transfer barrier layer contains at least one of a water-soluble polymer or inorganic fine particles. The water-soluble polymer and the inorganic fine particles may be used in combination. A surfactant may be used to disperse these materials.

The dye transfer barrier layer may be formed by coating in accordance to known means such as a gravure printing, a screen printing, or the like. The solid content after drying is preferably from 0.01 $g/m^2$ to 1.5 $g/m^2$, and more preferably from 0.05 $g/m^2$ to 0.8 $g/m^2$. If the dye transfer barrier layer is too thick, since thermal conductivity become worse, the deterioration of transferability-enhancing effect, that is a function of the dye transfer barrier layer, occurs. On the other hand, if the dye transfer barrier layer is too thin, coating unevenness becomes conspicuous, whereby sufficient dye transfer barrier-properties cannot be given.

[Dye Layer (Colorant Layer)]

(Binder Resin)

Examples of the binder resin used in the dye layer include acrylic resins such as polyacrylonitrile, polyacrylate, and polyacrylamide; polyvinyl acetal-series resins such as polyvinyl acetoacetal and polyvinyl butyral; cellulose-series resins such as ethylcellulose, hydroxyethylcellulose, ethylhydroxycellulose, hydroxypropylcellulose, ethylhydroxyethylcellulose, methylcellulose, cellulose acetate, cellulose acetate butyrate, cellulose acetate propionate, cellulose nitrate, other modified cellulose resins, nitrocellulose, and ethylhydroxyethylcellulose; other resins such as polyurethane resin, polyamide resin, polyester resin, polycarbonate resin, phenoxy resin, phenol resin, and epoxy resin; and various elastomers. These may be used alone, or two or more kinds thereof may be used in the form of a mixture or copolymer thereof.

(Dye)

The dye is not particularly limited, as long as it is able to diffuse by heat and able to be incorporated in the heat-sensitive transfer sheet, and able to transfer by heat from the heat-sensitive transfer sheet to the image-receiving sheet. As the dye used for the heat-sensitive transfer sheet, ordinarily used dyes or known dyes can be used.

Preferable examples of the dye include diarylmethane-series dyes, triarylmethane-series dyes, thiazole-series dyes, methine-series dyes such as merocyanine; azomethine-series dyes typically exemplified by indoaniline, acetophenoneazomethine, pyrazoloazomethine, imidazole azomethine, imidazo azomethine, and pyridone azomethine; xanthene-series dyes; oxazine-series dyes; cyanomethylene-series dyes typically exemplified by dicyanostyrene, and tricyanostyrene; thiazine-series dyes; azine-series dyes; acridine-series dyes; benzene azo-series dyes; azo-series dyes such as pyridone azo, thiophene azo, isothiazole azo, pyrrol azo, pyralazo, imidazole azo, thiadiazole azo, triazole azo, and disazo; spiropyran-series dyes; indolinospiropyran-series dyes; fluoran-series dyes; rhodaminelactam-series dyes; naphthoquinone-series dyes; anthraquinone-series dyes; and quinophthalon-series dyes.

Specific examples of a yellow dye that can be used in the present invention include Disperse Yellow 231, Disperse Yellow 201 and Solvent Yellow 93. Specific examples of a magenta dye that can be used in the present invention include Disperse Violet 26, Disperse Red 60, and Solvent Red 19. Specific examples of a cyan dye that can be used in the present invention include Solvent Blue 63, Solvent Blue 36, Disperse Blue 354 and Disperse Blue 35. The dye used in the present invention is not limited thereto. Further, dyes each having a different hue from each other as described above may be arbitrarily combined together.

The surface of the support may be subjected to treatment for easy adhesion to improve wettability and an adhesive property of the coating liquid. Examples of the treatment include known resin surface modifying techniques such as corona discharge treatment, flame treatment, ozone treatment, ultraviolet treatment, radial ray treatment, surface-roughening treatment, chemical agent treatment, vacuum plasma treatment, atmospheric plasma treatment, primer treatment, grafting treatment, and the like. An easy adhesion layer (easily-adhesive layer) may be formed on the support by coating. Examples of a resin used in the easily-adhesive layer include polyester-series resins, polyacrylate-series resins, polyvinyl acetate-series resins, vinyl-series resins such as polyvinyl chloride resin and polyvinyl alcohol resin, polyvinyl acetal-series resins such as polyvinyl acetoacetal and polyvinyl butyral, polyether-series resins, polyurethane-series resins, styrene acrylate-series resins, polyacrylamide-series resins, polyamide-series resins, polystyrene-series resins, polyethylene-series resins, and polypropylene-series resins.

When the film (layer) used for the support is formed by melt extrusion, it is allowable to subject a non-stretched film to coating treatment followed by stretching treatment.

The above-mentioned treatments may be used in combination of two or more thereof

[White Layer (White Transfer Layer)]

The white layer used in the heat-sensitive transfer sheet is constituted to include a white pigment to impart appropriate white concealability and light diffusibility to a printed material after transfer, and a binder resin. It is preferable to provide a peeling layer between the white layer and the support. Furthermore, an adhesive layer may be provided on the white layer. Herein, in the case where the white layer is transferred onto a pseudo-image without being mediated by the adhesive layer, a conventionally known binder resin having adhesiveness may be used, or an adhesive may be incorporated into the white layer. As the white pigment, typical white pigments as well as filler can be used. Therefore, the white pigment as used herein includes filler.

The white pigments are hard solid particles, and examples thereof include white pigments such as titanium oxide or zinc oxide; inorganic fillers such as silica, alumina, clay, talc, calcium carbonate, or barium sulfate; and resin particles (plastic pigments) such as an acrylic resin, an epoxy resin, a polyurethane resin, a phenol resin, a melamine resin, a benzoguanamine resin, a fluororesin, or a silicone resin. Titanium oxide includes rutile-type titanium oxide and anatase-type titanium oxide, but any of them may be used.

Any conventionally known binder resin can be used, but preferred examples include an acrylic resin, a cellulose-series resin, a polyester-series resin, a vinyl-series resin, a polyurethane-series resin, a polycarbonate-series resin, and partially crosslinked resins thereof.

To the white layer, a fluorescent whitening agent can be added, in addition to the white pigment and the binder resin. Known compounds having a fluorescent whitening effect, such as a stilbenzene-series compound and a pyrazoline-series compound, can be used as the fluorescent whitening agent. Further, a small amount of colorant may also be incorporated into the white layer.

The white layer is such that when a lenticular lens sheet printed material to which the white layer has been transferred is viewed under a transmitted light coming from a backlight, the white layer needs to have appropriate light diffusibility and light transmissibility. On the other hand, when the lenticular lens sheet printed material to which the white layer has been transferred is viewed under a reflected light coming from the front direction, the white layer needs to have appropriate light diffusibility and light reflectability. In the case of the latter, the total light ray transmittance of the white layer after transfer is preferably 60% or less, and particularly in the case of forming pseudo-images which may serve as a continuous image, the total light ray transmittance is preferably 50% or less.

In order to adjust the total light ray transmittance of the white layer after transfer to 60% or less and thereby to impart sufficient white concealability, it is preferable to set the ratio of a binder resin (A) and a white pigment (B) that constitute the white layer, within the range of A/B=1/1 to 1/10. It is particularly preferable to set the lower limit of this amount ratio at 1/1.5, and the upper limit at 1/6. The ratio of A/B is appropriately set in the range described above, depending on the material of the support sheet having a lenticular lens to which the white layer is transferred or the material of the receptor layer. If the ratio A/B is too large, the total light transmittance may exceed 60%, and the white concealability may be decreased. If the white pigment is incorporated in a large amount and the ratio A/B is too small, film coatability deteriorates. Thus, abrasion properties may be deteriorated, or adhesiveness may be deteriorated due to the decrease of the resin content.

The thickness of the white layer is adjusted to approximately 0.5 to 10 μm.

Measurement of the total light ray transmittance is carried out as stipulated in JIS K 7105. An excellent printed material can be formed by setting up the ratio A/B and the thickness of the white layer such that the total light ray transmittance of the white layer transfer section of the heat-sensitive transfer sheet is 60% or less, and preferably 50% or less.

The upper limit of the total light ray transmittance is particularly limited. It is preferable that the A/B and the thickness of the white layer are set so that the total light ray transmittance become as small as possible.

[Peeling Layer]

The peeling layer used in the heat-sensitive transfer sheet constitutes a white layer transfer section together with the white layer, and is formed between the support film and the white layer. The peeling layer is provided to prevent fusion of the heat-sensitive transfer sheet and the lenticular lens sheet, and to facilitate the transfer of the white layer on the receptor layer provided on the lenticular lens sheet without causing any transfer unevenness.

As the peeling layer, for example, a releasable peeling layer that separates from the interface between the peeling layer and the base film (support), or a cohesive peeling layer that causes cohesion failure within the peeling layer and thereby separates from the base film, can be formed.

The releasable peeling layer can be constructed by adding a releasable material to the binder resin, according to the necessity. Examples of the binder resin that can be used include thermoplastic resins, for example, acrylic resins such as polymethyl methacrylate, polyethyl methacrylate and polybutyl acrylate; vinyl-series resins such as polyvinyl acetate, vinyl chloride-vinyl acetate copolymers, polyvinyl alcohol, and polyvinyl butyral; and cellulose derivatives such as ethyl cellulose, nitrocellulose, and cellulose acetate; or thermosetting resins, for example, unsaturated polyester resins, polyester resins, polyurethane-series resins, aminoalkyd resins, and the like. The releasable peeling layer can be constructed from a composition composed of one kind or two or more kinds of these resins.

Examples of the releasable material include resins having releasability, such as waxes, silicone waxes, silicone oils, silicone-series resins, melamine resins, and fluororesins; lubricants such as talc, silica microparticles, surfactants, and metal soaps; and the like.

The releasable peeling layer can also be constructed from a resin having releasability. In this case, a silicone-series resin, a melamine resin, a fluororesin, and the like can be used, and a graft polymer produced by grafting a releasable segment such as a polysiloxane segment and a fluorinated carbon segment into the molecule of a resin such as an acrylic resin, a vinyl-series resin, and a polyester resin may be used as well. The releasable peeling layer can also be constructed from a composition containing one kind or two or more kinds of the resins mentioned above. The releasable peeling layer may further contain, in addition to the materials described above, a conventionally known fluorescent whitening agent having an effect of a fluorescent whitening of image, such as a stilbenzene-series compound and a pyrazoline-series compound.

The cohesive failing peeling layer causes so-called cohesive failure in the middle part of the peeling layer in the thickness direction when the white layer transfer section is transferred onto the receptor layer, and a portion of the peeling layer remains on the base film without being peeled off, and the other portion is transferred onto the printed material. When the cohesive failing peeling layer peels off and migrates onto the lenticular lens sheet, the concavo-convex shape of the cohesively failed surface is formed on the uppermost surface of the printed material. For example, in the case where the printed material is viewed under a transmitted light coming from a backlight, the concavo-convex formed on the uppermost surface of the printed material diffuses and reflects the illuminated light. This supplements the light diffusibility of the white layer, and thus a printed material with good visual quality, which has both satisfactory light diffusibility and light transmissibility, can be formed.

As materials for forming the cohesive failing peeling layer, a binder resin and a releasable material that is added according to the necessary are used. Examples of the binder resin that can be used include one kind or two or more kinds of resins selected from thermoplastic resins, for example, acrylic resins such as polymethyl methacrylate, polyethyl methacrylate and polybutyl acrylate; vinyl-series resins such as polyvinyl acetate, vinyl chloride-vinyl acetate copolymers, polyvinyl alcohol, and polyvinyl butyral; cellulose derivatives such as ethyl cellulose, nitrocellulose, and cellulose acetate; polyester resins, polyurethane resins, and the like. It is preferable that these binder resins include a resin having a Tg of 100° C. or a softening point of 100° C. or higher, so as to prevent fusion of the lenticular lens sheet and the support sheet at the time of heat transfer. Further, a resin having a Tg of below 100° C. or a softening point of below 100° C. can also be used, if combined with an appropriate releasable material.

Examples of the releasable material that can be used include waxes, inorganic microparticles such as talc, silica and the like, and organic microparticles. The releasable material is preferably added in an amount of 0.1 to 200% by mass, and more preferably 10 to 100% by mass, relative to the amount of the binder resin.

In the case where the releasable material is not used in the cohesive failing peeling layer, two or more kinds of resins that have low compatibility with each other among the binder resins mentioned above can be used, so that the peeling layer can be peeled off at the interface between the binder resins that form the peeling layer.

The white concealability of the printed material can be enhanced by incorporating a white pigment into the peeling layer. For example, in the case where the white concealability is insufficient, a printed material having sufficient white concealability can be obtained by incorporating the white pigment into the white layer as well as the peeling layer, and thereby adjusting the total light ray transmittance of the white layer and the peeling layer to 60% or less.

In the case where it is wished to impart adhesiveness to the white layer, or to enhance adhesiveness of the white layer, an adhesive binder resin can be incorporated into the white layer. However, in this case, the proportion of the white pigment is correspondingly decreased, and the white concealability may become insufficient. In order to supplement such white concealability of the white layer, the white pigment can be incorporated into the peeling layer, and thus a printed material having sufficient white concealability can be obtained.

As the white pigment contained in the peeling layer, titanium oxide, zinc oxide or the like can be used as described above. The content of the white pigment cannot be defined in a simple manner since the content is defined on the basis of the relationship with the white concealability of the white layer. However, in the case where the white pigment is added to the peeling layer, the addition amount is generally 100 to 500% by mass, the upper limit is preferably approximately 300% by mass, and the lower limit is approximately 200% by mass, to the amount of the binder resin that constitutes the peeling layer.

The releasable or cohesive failing peeling layer as discussed above may also be added with an ultraviolet absorbent, an antioxidizing agent, a fluorescent whitening agent (stilbenzene-series, pyrazoline-series compound, and the like) and the like, for enhancing the weather resistance performance, in addition to the materials described above.

The peeling layer can be formed by the same method as that used for the dye layer, and the thickness of the peeling layer is preferably 0.1 to 5.0 μm as obtained after coating and drying.

As the white layer and the peeling layer, those layers described in Japanese Patent No. 3789033 are preferably used.

[Adhesive Layer]

An adhesive layer may be provided on the white layer. A preferably applicable adhesive layer is the adhesive layer for the heat transferable protective layer.

[Heat Resistant Lubricating Layer]

In the heat-sensitive transfer sheet, it is preferred to dispose a heat-resistant lubricating layer (back side layer) on the surface (back side) of the support opposite to the surface on which the dye layer is formed, namely on the side of the support with which a thermal head and the like contact. Further, in the case of a white layer transfer sheet and protective layer transfer sheet, it is also preferred to dispose the heat-resistant lubricating layer on the side of the support with which the thermal head and the like contact.

If the heat-sensitive transfer sheet is heated by a heating device such as a thermal head in the state such that the back side of the support of the heat-sensitive transfer sheet directly contacts with the heating device, thermal fusion bonding is apt to occur. In addition, owing to a large friction between them, it is difficult to smoothly transfer the heat-sensitive transfer sheet at the time of printing.

The back side layer is disposed so as to enable the heat-sensitive transfer sheet to withstand heat energy from the thermal head. The heat-resistant lubricating layer prevents the thermal fusion bonding, and enables a smooth travel action. Recently, the necessity of the heat-resistant lubricating layer becomes large on account that the heat energy from the thermal head increases in association with speeding-up of the printer.

The heat-resistant lubricating layer is formed by coating a binder to which a lubricating agent, a release agent, a surfactant, inorganic particles, organic particles, pigments, and the like are added. Further, an intermediate layer may be disposed between the back side layer and the support. As the heat-resistant lubricating layer, there has been known a layer containing inorganic fine particles and a water-soluble resin or a hydrophilic resin capable of emulsification.

As the binder, a known resin having high heat-resistance may be used. Examples thereof include cellulose resins such as ethylcellulose, hydroxycellulose, hydroxypropylcellulose, methylcellulose, cellulose acetate, cellulose acetate butyrate, cellulose acetate propionate, and nitrocellulose; vinyl-series resins such as polyvinyl alcohol, polyvinyl acetate, polyvinyl butyral, polyvinyl acetal, polyvinyl acetoacetal resin, vinyl chloride-vinyl acetal copolymer, and polyvinylpyrrolidone; acrylic resins such as methyl polymethacrylate, ethyl polyacrylate, polyacrylamide, and acrylonitrile-styrene copolymer; and natural or synthetic resins such as polyamide resin, polyimide resin, polyamideimide resin, polyvinyl toluene resin, coumarone indene resin, polyester-series resin, polyurethane resin, polyether resin, polybutadiene resin, polycarbonate resin, chlorinated polyolefin resin, fluorine-contained resin, epoxy resin, phenol resin, silicone resin, silicone-modified or fluorine-modified urethane. These may be used alone or in the mixture thereof.

In order to enhance heat resistance of the heat-resistant lubricating layer, there have been known techniques of cross-linking resins by ultraviolet ray or electron beam radiation. Further, the resin may be cross-linked by heating with a cross-linking agent. According to need, a catalyst may be added to the resin. As the exemplary cross-linking agent, polyisocyanate and the like are known. When the polyisocyanate is used, a resin with a hydroxyl group-based functional group is suited to be cross-linked. JP-A-62-259889 discloses a back side layer formed of a reaction product of polyvinyl butyral and an isocyanate compound, to which a bulking agent such as an alkali metal salt or alkaline earth metal salt of phosphoric ester and potassium carbonate is added. JP-A-6-99671 discloses that a heat resistant lubricating layer-forming high molecular compound can be obtained by reacting a silicone compound having an amino group and an isocyanate compound having two or more isocyanate groups in one molecule.

In order to sufficiently exhibit the function, the back side layer may be incorporated with additives such as a lubricating agent, a plasticizer, a stabilizer, a bulking agent, and a filler for removing materials adhered to the head.

Examples of the lubricating agent include fluorides such as calcium fluoride, barium fluoride, and graphite fluoride; sulfides such as molybdenum disulfide, tungsten disulfide, and iron sulfide; oxides such as lead oxide, alumina, and molybdenum oxide; solid lubricating agents composed of inorganic compounds such as graphite, mica, boron nitride, and clays (e.g., talc, acid white clay); organic resins such as fluorine resins and silicone resins; silicone oil; metal soaps such as metal salt of stearic acid; various kinds of waxes such as polyethylene wax and paraffin wax; and surfactants such as anionic surfactants, cationic surfactants, amphoteric surfactants, nonionic surfactants, and fluorine-containing surfactants.

Phosphoric ester surfactants such as zinc salt of alkyl phosphoric monoester or alkyl phosphoric diester may be used. However, the acid group of the phosphate causes a disadvantage such that the phosphate decomposes as a heat quantity from a thermal head becomes large, and consequently the pH of the back side layer reduces, corrosive abrasion of the thermal head becomes heavy. As a measure to deal with the disadvantage, there are known, for example, a method of using a neutralized phosphate-series surfactant, and a method of using a neutralizing agent such as magnesium hydroxide.

Examples of the other additives include higher fatty acid alcohols, organopolysiloxane, organic carboxylic acids and derivatives thereof, and fine particles of inorganic compounds such as talc and silica.

The heat-resistant lubricating layer is formed by adding additives to the binder exemplified above, dissolving or dispersing the resultant into a solvent to prepare a coating liquid, and then applying the coating liquid by a known method such as gravure coating, roll coating, blade coating, or wire bar coating. The film thickness of the heat-resistant lubricating layer is preferably approximately from 0.1 to 10 μm, more preferably approximately from 0.5 to 5 μm.

<Method of Forming an Image and System>

In the method of forming an image of the present invention itself, utilizing the heat-sensitive transfer image-receiving sheet, and the system of the present invention itself, being used in the method, ordinary methods and systems may be used. That is, imaging is formed by superposing the heat-sensitive transfer sheet on the heat-sensitive transfer image-receiving sheet in the present invention so that the dye layer (colorant layer) of the heat-sensitive transfer sheet is in contact with the receptor layer of the heat-sensitive transfer image-receiving sheet, and applying thermal energy in accordance with image signals from the thermal head. Specifically, an image formation may be conducted in the similar manner to the method described in, for example, JP-A-2005-88545 and in accordance with the system using the apparatus described in JP-A-2005-88545. In the present invention, a sublimation transfer type image-forming method is particularly preferred.

In regard to stereoscopic images, it is necessary to print the image at a precise position in accordance with the concavo-convex of the lenticular lens. In connection with this method, the method described in Japanese Patent No. 3609065 or the like can be used.

In the system of the present invention, the heater length of the thermal head is preferably 45 μm or less. Herein, the term "heater length" refers to a length of a portion of a heater element, in which the portion is not covered with an electrode and the length is parallel to a direction of heat-sensitive transfer image-receiving sheet movement. In the case of using a printer which is capable of recording a 3D image data with a thermal head on a lenticular sheet, high resolution in a vertical scanning direction is required in order to print a multi-view image on the lenses arranged in the vertical scanning direction. The heater length is preferably 45 μm or less, more preferably 30 μm or less. The lower limit of the heater length is not particularly limited, but the lower limit is preferably 10 μM or more.

The present invention is contemplated for providing a method of forming an image using a heat-sensitive transfer image-receiving sheet having a Inticular lens and a heat-sensitive transfer sheet, which is able to stably print a high-definition three dimensional image with a high density of print and less image troubles (ribbon wrinkle, shift of register in color printing) at the time of printing.

According to the present invention, a method of forming an image and system of forming an image can be provided which are able to stably print a high-density and high-definition three dimensional image with less image troubles such as ribbon wrinkle and shift of register in color printing.

EXAMPLES

The present invention will be described in more detail based on the following examples. Any materials, reagents, amount and ratio of use and operations, as shown in the examples, may appropriately be modified without departing from the spirit and scope of the present invention. It is therefore understood that the present invention is by no means intended to be limited to the specific examples below. In the following Examples, the terms "part" and "%" are values by mass, unless they are indicated differently in particular.

Example 1

Production of Heat-sensitive Transfer Image-receiving Sheet)

Heat-sensitive transfer image-receiving sheet 1 was produced by the following procedure, according to the process chart of FIG. 1.

(1) A biaxially streched polyethylene terephthalate (PET) film (manufactured by Fujifilm Corp.) having the thickness of 188 μm was used as a transparent support, and the PET film (thickness 188 μm) which was running at a rate of 10 m/min was inserted between a mirror-surface roller (ϕ350 mm, surface temperature 15° C.) and a nip roller. A glycol-modified polyethylene terephthalate resin PETG (manufactured by SK Chemicals Corp.) and an adhesive resin (trade name: ADMER, manufactured by Mitsui Chemicals, Inc.) were co-extruded from a T-die (ejection width 350 mm) set up at a temperature of 280° C., at a measured resin temperature of 260 to 280° C., and were supplied between the PET film and the mirror-surface roller. Thus, a sheet having a subbing layer (thickness 220 μm) formed thereon was rolled up by a rolling step.

(2) The receptor layer coating liquid described below was coated on the subbing layer by the method exemplified in FIG. 9 illustrated in U.S. Pat. No. 2,761,791, in an amount of 3.0 g/m$^2$, and thus a receptor layer was provided by coating.

(3) The resin sheet provided with the subbing layer and the receptor layer thereon was wound off at a rate of 10 m/min in a conveyance step, and was inserted between an embossed roller (ϕ350 mm, 40° C.) having a lenticular lens shape (radius 150 μM, lens height 70 μm, pitch 254 μm) and a nip roller. A glycol-modified polyethylene terephthalate resin PETG (manufactured by SK Chemicals Corp.) and the adhesive resin (trade name: ADMER, manufactured by Mitsui Chemicals, Inc.) were co-extruded from a T-die (ejection width 330 mm) set up at a temperature of 280° C., at a measured resin temperature of 260 to 280° C., and were supplied between the resin sheet and the embossed roller to be laminated. Thus, a lenticular sheet (thickness 340 μm) could be obtained. In the below-described Table 1, the lenticular resin layer and the adhesive resin layer (average thickness: 20 μm) provided thereon were referred to as an upper layer and a lower layer, respectively. In the same manner, the subbing layer and the adhesive resin layer (average thickness: 10 μm) provided thereon were referred to as an upper layer and a lower layer, respectively.

(Synthesis of Polyether-modified Silicone)

Synthesis of the polyether-modified silicone represented by formula (S1) used in the present invention can be carried out using the known methods described in Kunio Itoh, "Silicone Handbook" (Nikkan Kogyo Shimbun Co., Ltd., 1990, p. 163) and the like.

Specifically, in a glass flask equipped with a stirring device and a thermometer, 20 parts by mass of a dimethylsiloxane-methyl hydrogen siloxane copolymer represented by the average structural formula (1):

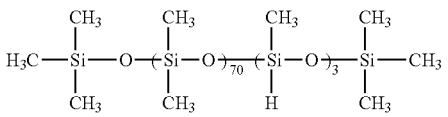

and 40 parts by mass of a single-terminal allyl etherified polyoxyalkylene represented by the average structural formula (2): $CH_2{=}CHCH_2O(C_2H_4O)_{50}(C_3H_6O)_{50}CH_3$ were mixed, and 20 parts by mass of isopropyl alcohol was added as a solvent. Furthermore, chloroplatinic acid was added thereto. After the mixture was stirred for 2 hours at 86° C., it was confirmed that the peak representing Si—H in the infrared absorption spectrum disappeared. The mixture was further stirred for 30 minutes. The reaction liquid was concentrated under reduced pressure, and thereby a polyether-modified silicone S1-1 below was obtained.

| Receptor layer coating liquid 1 | |
|---|---|
| Vinyl chloride/acrylic latex copolymer (trade name: Vinybran 900, manufactured by Nissin Chemical Industry Co., Ltd., solid content: 40%,) | 20.0 mass parts |
| Vinyl chloride/acrylic latex copolymer (trade name: Vinybran 690, manufactured by Nissin Chemical Industry Co., Ltd., solid content: 55%,) | 25.0 mass parts |
| Polyvinylpyrrolidone (trade name: K-90, manufactured by ISP Japan Ltd.) | 1.5 mass parts |
| The above-described polyether-modified silicone S1-1(100%) | 1.5 mass parts |
| Anionic surfactant A1-1 | 0.5 mass part |
| Water | 50.0 mass parts |

(Preparation of Heat-sensitive Transfer Image-receiving Sheets 2 to 5)

Heat-sensitive transfer image-receiving sheets 2 to 5 were produced in the same manner as the heat-sensitive transfer image-receiving sheet 1, except that the glycol-modified polyethylene terephthalate (PETG) resin used in the subbing layer and the lenticular lens was changed to a polyethylene (PE) resin or the like as indicated in Table 2 shown below. Further, when a polyethylene resin (trade name: SUMIKA SEN L405, manufactured by Sumitomo Chemical Co., Ltd.) was used, the T-die temperature was set up at 290° C., and the measured resin temperature was adjusted to 270 to 290° C.

As an indicator of hardness, an automatic micro-Vickers hardness testing system (trade name: HMV-FA, manufactured by Shimadzu Corporation) was used, in which the Vickers indenter was changed to a spherical indenter having a diameter of 0.2 mm, and the indenter was put at the side of the heat-sensitive transfer image-receiving sheet, in which the receptor layer was provided and then the heat-sensitive transfer image-receiving sheet was subjected to weight bearing of 200 mN over a period of 10 seconds, and thereafter the weight was reduced to 0 over a period of 10 seconds. A maximum amount of displacement (μm) each of the heat-sensitive transfer image-receiving sheets at this time was measured.

TABLE 1

| Heat-sensitive transfer image-receiving sheet No. | Lenticular layer | | Subbing layer | | Displacement amount of Spherical indenter hardness (μm) |
|---|---|---|---|---|---|
| | Upper layer | Lower layer | Upper layer | Lower layer | |
| 1 (This invention) | PETG | ADMER | PETG | ADMER | 3.4 |
| 2 (Comparative example) | PETG | ADMER | None | None | 2.3 |

TABLE 1-continued

| Heat-sensitive transfer image-receiving sheet No. | Lenticular layer | | Subbing layer | | Displacement amount of Spherical indenter hardness (μm) |
|---|---|---|---|---|---|
| | Upper layer | Lower layer | Upper layer | Lower layer | |
| 3 (Comparative example) | PE | ADMER | PETG | None | 2.2 |
| 4 (Comparative example) | PETG | ADMER | PE | None | 3.8 |

The displacement of spherical indenter hardness of the transparent support was 2.3 μm.

(Production of Heat-Sensitive Transfer Sheet A)

A polyester film having the thickness of 6.0 μm (trade name: Diafoil K200E-6F, manufactured by MITSUBISHI POLYESTER FILM CORPORATION), that was subjected to an easy-adhesion-treatment on one surface of the film, was used as a support. The following heat resistant lubricating layer coating liquid was applied on the other surface of the support that was not subjected to the easy-adhesion-treatment, so that the coating amount based on the solid content after drying would be 1 g/m$^2$. After drying, the coating liquid was cured by heat at 60° C.

Coating liquid for dye transfer barrier layer described below was applied onto the easily-adhesive layer coated surface of the thus-formed polyester film so that a dye transfer barrier layer would be 0.3 g/m$^2$. Then, individual dye layers in yellow, magenta, and cyan were coated on the dye transfer barrier layer in area order. In this way, a heat-sensitive transfer sheet A was produced. The solid coating amount in each of the dye layers was set to 0.8 g/m$^2$.

| Coating Liquid for heat resistant lubricating layer | |
|---|---|
| Acrylic-series polyol resin (trade name: ACRYDIC A-801, manufactured by Dainippon Ink and Chemicals, Incorporated) | 26.0 mass parts |
| Zinc stearate (trade name: SZ-2000, manufactured by Sakai Chemical Industry Co., Ltd.) | 0.43 mass part |
| Phosphate (trade name: PLYSURF A217, manufactured by Dai-ichi Kogyo Seiyaku Co., Ltd.) | 1.27 mass parts |
| Isocyanate (50% solution) (trade name: BURNOCK D-800, manufactured by Dainippon Ink and Chemicals, Incorporated) | 8.0 mass parts |
| Methyl ethyl ketone/toluene (2/1, at mass ratio) | 64 mass parts |
| **Coating liquid for dye transfer barrier layer** | |
| Almina sol (trade name: Almina sol 200, manufactured by Nissan Chemical Industries, Ltd.) | 35.0 mass parts |
| Water | 25.0 mass parts |
| Isopropyl alcohol | 40.0 mass parts |
| **Coating liquid for yellow dye layer** | |
| The following yellow dye | 8.0 mass parts |
| Polyvinylacetal resin (trade name: S-LEC KS-1, manufactured by Sekisui Chemical Co., Ltd.) | 7.0 mass parts |
| Polyvinylbutyral resin (trade name: DENKA BUTYRAL #6000-C, manufactured by DENKI KAGAKU KOGYOU K. K.) | 1.1 mass parts |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/toluene (2/1, at mass ratio) | 84 mass parts |

-continued

| Coating liquid for magenta dye layer | |
|---|---|
| The following magenta dye | 8.5 mass parts |
| Polyvinylacetal resin (trade name: S-LEC KS-1, manufactured by Sekisui Chemical Co., Ltd.) | 8.0 mass parts |
| Polyvinylbutyral resin (trade name: DENKA BUTYRAL #6000-C, manufactured by DENKI KAGAKU KOGYOU K. K.) | 0.2 mass part |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/toluene (2/1, at mass ratio) | 84 mass parts |

| Coating liquid cyan dye layer | |
|---|---|
| The following cyan dye | 8.5 mass parts |
| Polyvinylacetal resin (trade name: S-LEC KS-1, manufactured by Sekisui Chemical Co., Ltd.) | 8.0 mass parts |
| Polyvinylbutyral resin (trade name: DENKA BUTYRAL #6000-C, manufactured by DENKI KAGAKU KOGYOU K. K.) | 0.8 mass part |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/toluene (2/1, at mass ratio) | 84 mass parts |

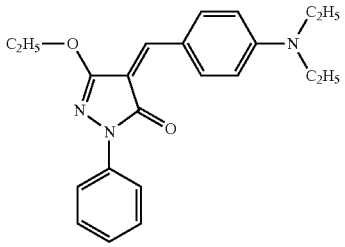

Yellow dye

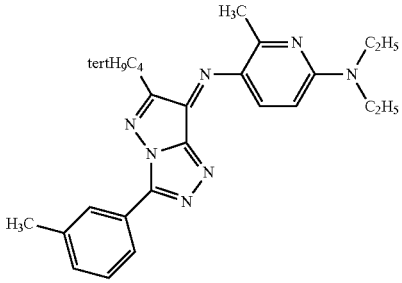

Magenta dye

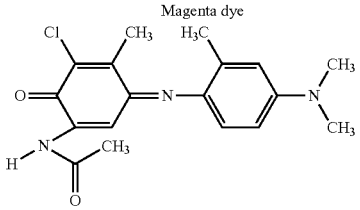

Cyan dye

A transferable white layer laminate was formed by applying a peeling layer coating liquid and a white layer coating liquid having compositions as shown below on the same polyester film as that on which the dye layers were coated, according to the method described in Japanese Patent No. 3789033. The coating amount at the time of film drying was set at 0.6 g/m$^2$ for the peeling layer and 2.0 g/m$^2$ for the white layer.

| Coating liquid for peeling layer | |
|---|---|
| Acrylic resin (trade name: LP-45M, manufactured by Soken Chemical Co., Ltd.) | 16 mass parts |
| Polyethylene wax (average particle size: approximately 1.1 μm) | 8 mass parts |
| Toluene | 76 mass parts |

| Coating liquid for white layer | |
|---|---|
| Modified acrylic resin (trade name: ACRYDICK BZ-1160, manufactured by Dainippon Ink Co., Ltd.) | 20 mass parts |
| Anatase-type titanium oxide (trade name: TCA888, manufactured by Tochem Products Co., Ltd.) | 40 mass parts |
| Fluorescent whitening agent (trade name: UVITEX OB, manufactured by Ciba-Geigy Corp.) | 0.3 mass part |
| Toluene/isopropyl alcohol (1/1, at mass ratio) | 40 mass parts |

(Production of Heat-Sensitive Transfer Sheet B)

A heat-sensitive transfer sheet B was prepared in the same manner as the heat-sensitive transfer sheet A, except that the dye transfer barrier layer was not used, (Image Forming Method)

In the printer for forming images, a thermal head having a heater length of 42 μm was used according to a method described in, for example, JP-A-2000-94729. Images were output under the setup condition in which gray gradation was able to be obtained all over the range of from the lowest density to the highest density. Further, for three-dimensional images, images from six-view points were printed onto a lens with 100 Lpi pitch. Samples in which each of the heat-sensitive transfer image-receiving sheets 1 to 4 and the heat-sensitive transfer sheet A were used in combination were designated as samples 101 to 104, respectively, and a sample in which the heat-sensitive transfer image-receiving sheet 1 and the heat-sensitive transfer sheet B were used in combination was designated as sample 105.

(Evaluation of Dmax)

The visual density of black image obtained in the above condition was measured by Photographic Densitometer (trade name, manufactured by X-Rite Incorporated).

(Evaluation of Ribbon Wrinkles Transfer)

In each of the combinations of the heat-sensitive transfer image-receiving sheets and the heat-sensitive transfer sheets, 30 sheets of 6 inch×9 inch size image that was split fifty/fifty between the black image at the above Dmax portion and the white image were continuously printed to count the number of wrinkle-shape failures generated therein.

(Evaluation of Shift of Register in Color Printing)

30 sheets of 6 inch×9 inch size image having black fine lines, respectively, parallel to and perpendicular to the print direction were continuously printed to evaluate the degree of a shift of the register in the color printing of the printed matter by observation by the naked eyes.

Score 5: the number of sheet is zero, in which a shift of the register in the color printing was caused.

Score 4: the number of sheet is less than 3, in which a shift of the register in the color printing was caused.

Score 3: the number of sheet is 3 or more and less than 5, in which a shift of the register in the color printing was caused.

Score 2: the number of sheet is 5 or more and less than 10, in which a shift of the register in the color printing was caused.

Score 1: the number of sheet is more than 10, in which a shift of the register in the color printing was caused.

(Evaluation of Image-breach Trouble)

In each of the combination of the heat-sensitive transfer image-receiving sheets and the heat-sensitive transfer sheets, 100 sheets of 6 inch×9 inch size snapshot were continuously printed to count the number of image-breach troubles generated therein, i.e. the number of spots at which image was not correctly transferred.

(Evaluation of Barrier Property)

With respect to the cyan dye portion of the heat-sensitive transfer sheet after printing process, a cyan dye at the Dmax portion was removed with methanol, and then measurement of the dye having penetrated into a polyester film was performed in terms of a spectral absorption spectrum. The measurement of spectral absorption spectrum was performed by utilizing a spectrophotometer U-3310 (trade name, manufactured by Hitachi Ltd.). Evaluation of barrier property was performed in terms of maximum absorbance of the spectral absorption spectrum after removal of the dye as described above. The barrier property means that the lower the value of thus-measured maximum absorbance is, the more the dye is difficult to penetrate into a polyester film, which is more preferable.

The results are shown in the following Table 2.

Herein, the descriptions in [ ] shown in Sample No. column of Table 2 indicate "heat-sensitive image-receiving transfer sheet No./kind of heat-sensitive transfer sheet".

As shown in the following Table 2, it is seen that the sample 101 according to the combination of the present invention (the combination of the heat-sensitive image-receiving transfer sheet 1, which satisfied the limitation of the present invention, and the heat-sensitive transfer sheet A, which satisfied the limitation of the present invention) exhibited conspicuous effects on achievement of high Dmax, and reduction in ribbon wrinkling, shift of register in color printing, and image-breach trouble, compared with the samples 102, 103, 104 and 105, in which the combination of the heat-sensitive image-receiving transfer sheet and the heat-sensitive transfer sheet for comparison was used.

TABLE 2

| | Evaluation of print output | | | | |
|---|---|---|---|---|---|
| Sample No. | Dmax | Ribbon wrinkle (number/ 30 sheets) | Shift of register in color printing | Image-breach trouble (number of times/, 100 sheets) | Evaluation of barrier property |
| 101 (This invention) [1/A] | 2.52 | 5 | 5 | 0 | 0.16 |
| 102 (Comparative example) [2/A] | 2.47 | 34 | 2 | 28 | 0.18 |
| 103 (Comparative example) [3/A] | 2.50 | 27 | 1 | 27 | 0.20 |
| 104 (Comparative example) [4/A] | 2.45 | 4 | 5 | 32 | 0.17 |
| 105 (Comparative example) [1/B] | 1.83 | 7 | 5 | 2 | 1.23 |

Example 2

A heat-sensitive transfer sheet C was prepared in the same manner as the heat-sensitive transfer sheet A, except that alumina sol in the dye transfer barrier layer of the heat-sensitive transfer sheet A was replaced with titanium oxide sol (Ti-Nanoxide HT, trade name, manufactured by Soralonix Corporation). Then, samples 201 to 204 were prepared in the same manner as samples 101 to 104, except that each of the combinations with the heat-sensitive transfer sheet A, corresponding to the samples 101 to 104of Example 1, was replaced with each of combinations with the heat-sensitive transfer sheet C. Evaluation of the samples 201 to 204 was conducted in the same manner as in Example 1. As a result, similar to Example 1, although there is some difference in effects, only the sample 201 of the combination satisfying the limitation of the present invention exhibited conspicuous effects on achievement of high Dmax, and reduction in ribbon wrinkle, shift of register in color printing, and image-breach trouble.

Example 3

A heat-sensitive transfer sheet D was prepared in the same manner as the heat-sensitive transfer sheet A, except that alumina sol in the dye transfer barrier layer of the heat-sensitive transfer sheet A was replaced with colloidal silica (trade name: SNOWTEX OSX; manufactured by Nissan Chemical Industries, Ltd.). Then, samples 301 to 304 were prepared in the same manner as samples 101 to 104, except that each of the combinations with the heat-sensitive transfer sheet A, corresponding to the samples 101 to 104 of Example 1, was replaced with each of combinations with the heat-sensitive transfer sheet D. Evaluation of samples 301 to 304 was conducted in the same manner as in Example 1. As a result, similar to Example 1, although there is some difference in effects, only the sample 301 of the combination satisfying the limitation of the present invention exhibited conspicuous effects on achievement of high Dmax, and reduction in ribbon wrinkle, shift of register in color printing, and image-breach trouble.

Example 4

A heat-sensitive transfer sheet E was prepared in the same manner as the heat-sensitive transfer sheet A, except that alumina sol in the dye transfer barrier layer of the heat-sensitive transfer sheet A was replaced with polyvinylpyrrolidone resin (trade name: K-90, manufactured by ISP). Then, samples 401 to 404 were prepared in the same manner as samples 101 to 104, except that each of the combinations with the heat-sensitive transfer sheet A, corresponding to the samples 101 to 104 of Example 1, was replaced with each of combinations with the heat-sensitive transfer sheet E. Evaluation of samples 401 to 404 was conducted in the same manner as in Example 1. As a result, similar to Example 1, although there is some difference in effects, only the sample 401 of the combination satisfying the limitation of the present invention exhibited conspicuous effects on achievement of high Dmax, and reduction in ribbon wrinkle, shift of register in color printing, and image-breach trouble.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2010-219518 filed in Japan on Sep. 29, 2010, which is entirely herein incorporated by reference.

I claim:

1. A method of forming an image, comprising the steps of:

superposing a heat-sensitive transfer sheet on a heat-sensitive transfer image-receiving sheet; and applying thermal energy in accordance with image signals from a thermal head, wherein the heat-sensitive transfer sheet has a dye transfer barrier layer containing at least one kind of a water-soluble polymer or at least one kind of inorganic fine particles between a support and a dye layer, wherein the heat-sensitive transfer image-receiving sheet has a lenticular lens on a transparent support and at least one receptor layer at the back side of the transparent support, and wherein the heat-sensitive transfer image-receiving sheet contains at least one kind of a latex polymer in said at least one receptor layer and has a subbing layer which contains at least one kind of a resin that is identical with at least one kind of a resin constituting the lenticular lens, at the side of the transparent support, opposite to the side on which the lenticular lens is provided.

2. The method of forming an image according to claim 1, wherein said at least one kind of a resin that constitutes the subbing layer and is identical with said at least one kind of a resin that constitutes the lenticular lens is a polymethyl methacrylate resin, a polycarbonate resin, a polystyrene resin, a methacrylate-styrene copolymer resin, a polyethylene resin, a polyethylene terephthalate resin, or a glycol-modified polyethylene terephthalate resin.

3. The method of forming an image according to claim 1, wherein said at least one of a resin that constitutes the subbing layer and is identical with said at least one kind of a resin that constitutes the lenticular lens is a glycol-modified polyethylene terephthalate resin.

4. The method of forming an image according to claim 1, wherein at least one kind of the latex polymer is a copolymer containing a vinyl chloride component as a constituent component.

5. The method of forming an image according to claim 1, wherein at least one of the latex polymer is a vinyl chloride homopolymer or a vinyl chloride/acrylic acid ester copolymer.

6. The method of forming an image according to claim 1, wherein the transparent support is a polyethylene terephthalate resin.

7. The method of forming an image according to claim 1, wherein the water-soluble polymer contained in the dye transfer barrier layer is one selected from the group consisting of a water-soluble polymer having a repeating unit obtained from N-vinylpyrrolidone, a gelatin, and a polyvinyl alcohol.

8. The method of forming an image according to claim 1, wherein the inorganic fine particles contained in the dye transfer barrier layer are one selected from the group consisting of colloidal silica, alumina sols, and titanium oxide sols.

9. A system of forming an image, comprising the steps of:

superposing a heat-sensitive transfer sheet on a heat-sensitive transfer image-receiving sheet; and applying thermal energy in accordance with image signals from a thermal head, wherein the heat-sensitive transfer sheet has a dye transfer barrier layer containing at least one kind of a water-soluble polymer or at least one kind of inorganic particles between a support and a dye layer, wherein the heat-sensitive transfer image-receiving sheet has a lenticular lens on a transparent support and at least one receptor layer at the back side of the transparent support, and wherein the heat-sensitive transfer image-receiving sheet contains at least one kind of a latex polymer and has a subbing layer which contains at least one kind of a resin that is identical with at least one kind of a resin constituting the lenticular lens, at the side of the transparent support, opposite to the side on which the lenticular lens is provided.

* * * * *